US007737899B1

(12) United States Patent
McKinzie, III

(10) Patent No.: US 7,737,899 B1
(45) Date of Patent: Jun. 15, 2010

(54) ELECTRICALLY-THIN BANDPASS RADOME WITH ISOLATED INDUCTIVE GRIDS

(75) Inventor: William E. McKinzie, III, Fulton, MD (US)

(73) Assignee: Wemtec, Inc., Fulton, MD (US)

( * ) Notice: Subject to any disclaimer, the term of this patent is extended or adjusted under 35 U.S.C. 154(b) by 376 days.

(21) Appl. No.: 11/825,206

(22) Filed: Jul. 5, 2007

Related U.S. Application Data

(60) Provisional application No. 60/830,515, filed on Jul. 13, 2006, provisional application No. 60/860,510, filed on Nov. 20, 2006.

(51) Int. Cl.
*H01Q 19/00* (2006.01)

(52) U.S. Cl. ..... 343/756; 343/700 MS; 343/909

(58) Field of Classification Search ..... 343/700 MS, 343/829, 846, 756, 909
See application file for complete search history.

(56) References Cited

U.S. PATENT DOCUMENTS 4,162,499 A * 7/1979 Jones et al. ..... 343/700 MS
4,410,891 A * 10/1983 Schaubert et al. ..... 343/700 MS
4,485,362 A * 11/1984 Campi et al. ..... 333/128
6,157,348 A * 12/2000 Openlander ..... 343/846
6,476,771 B1 11/2002 McKinzie, III
6,882,316 B2 * 4/2005 McKinzie et al. ..... 343/700 MS

OTHER PUBLICATIONS

Munk, Ben A., "Frequency Selective Surfaces," Chapter 7, "Band-Pass Filter Designs: The Hybrid Radome," John Wiley & Sons, Inc., 2000, pp. 227-278.
McKinzie, Will, et al., "An Electrically-Thin, Two-Pole, Bandpass Radome," 2003 IEEE Antennas and Propagation Symposium, Jun. 2003, Columbus, Ohio, pp. 1-4.

* cited by examiner

*Primary Examiner*—Tho G Phan
(74) *Attorney, Agent, or Firm*—Brinks, Hofer, Gilson & Lione

(57) ABSTRACT

A bandpass radome is described including inductive layers comprising periodic conductive grids. First and second capacitive patch layers may be disposed above, and third and fourth capacitive patch layers may be disposed below the inductive layer to realize a 2-pole bandpass radome. An additional inductive layer and a fifth and sixth capacitive patch layers may be added below the fourth capacitive layer to realize a 3-pole bandpass radome. Conductive posts may connect one of the uppermost patch layers to one of the lowermost patch layers without connecting to the intervening inductive conductive grids. The conductive posts may form a rodded medium to suppress transverse magnetic (TM) surface waves. The total thickness of the bandpass radome may be less than 1/30 of a free-space wavelength at the center of a passband frequency. More than one passband may be separated by a ratio of center frequencies exceeding 1.5.

60 Claims, 19 Drawing Sheets

ELECTRICALLY-THIN BANDPASS RADOME WITH ISOLATED INDUCTIVE GRIDS

This application claims the benefit of U.S. provisional application Ser. No. 60/830,515, filed on Jul. 13, 2006, and U.S. provisional application Ser. No. 60/860,510, filed on Nov. 20, 2006, each of which is incorporated herein by reference

TECHNICAL FIELD

This application relates to periodic metallo-dielectric structures. In particular, the metallo-dielectric structures may be used as frequency selective surfaces to filter electromagnetic waves.

BACKGROUND

Bandpass radomes constructed with Frequency Selective Surfaces (FSS) typically use resonant FSS elements that are approximately one half of a wavelength long in their largest dimension at the passband center frequency. Such half-wavelength elements typically exhibit multiple resonances such that, at normal incidence, a radome having a passband centered at $f_o$ exhibits spurious resonances at $3f_o$, $5f_o$, $5f_o$, etc. At oblique incidence, spurious resonances may also occur near $2f_o$, $4f_o$, $6f_o$, etc. In addition, such resonant element radomes will typically support the propagation of undesired surface wave electromagnetic wave modes excited at edges of the structure or at other discontinuities. The surface waves can radiate energy to produce radiation pattern anomalies for an antenna system where the radome is used to cover the antenna.

Bandpass radomes may be used in antenna system applications where one desires to allow transmission of electromagnetic waves in one or more ranges of radio frequencies and to suppress the transmission of waves at other frequencies. Such bandpass radomes may have dielectric layers that are each approximately $\lambda/4$ (one-quarter of a free-space wavelength) in thickness. At high microwave frequencies, $\lambda/4$ is a relatively small dimension, but at UHF frequencies (300 MHz to 1 GHz) or even low microwave frequencies (1-3 GHz), $\lambda/4$ can be too large for some applications. Hence there exists a need for electrically-thin and physically thin bandpass radomes. Furthermore, thin bandpass radomes may have less mass than conventional bandpass radomes due to thinner dielectric layers.

SUMMARY

A frequency selective surface, which may be a frequency selective radome (FSR) is described, including a first and a second patch layer disposed in relatively close proximity to each other. The term "relatively close" will be understood by persons skilled in the art as being substantially less than a wavelength at a frequency within a transmission frequency window. Third and fourth FSS patch layers may be disposed in relatively close proximity to each other. A dielectric region may be disposed between the second and third patch layers the dielectric region containing a pair of parallel inductive grids.

The FSR may be a mechanically-balanced structure where the layers are symmetrical about a plane. The first and second patch layers as well as one of the inductive grid layers may be disposed above the plane of symmetry and the third and fourth FSS patch layer and a second inductive grid layer may be disposed below the plane of symmetry.

In an aspect, the FSR may include a first array of conducting posts that connect the first patch layer to the fourth patch layer, and may further include a second array of conducting posts that connect the second patch layer to the third patch layer. The conducting posts form a rodded medium and the spatial period and dimensions of the conductive posts may suppress TM (transverse magnetic) surface wave modes over a desired band of frequencies.

In another aspect, the patch layers use an array of rectangular patches. The term rectangular will be understood by a person of skill in the art to represent any structure having generally a regular shape and where the principal dimensions are roughly comparable, such as a square, circle, triangle, pentagon, or the like. For example, the rectangular patches may have rebated or mitered corners to provide clearance between the patches and conductive posts. In yet another aspect the patches may be formed with interdigitating portions. The conductive posts may be plated thru holes in a dielectric layer.

A dielectric layer of thickness t may separate the first and second patch layers. A first dielectric layer of thickness $d_1$ may separate the second patch layer from the upper inductive grid. A second dielectric layer of thickness $d_2$ may separate the upper and lower inductive grids, and third dielectric layer of thickness $d_3$ may separate the lower inductive grid from the third patch layer. A fourth dielectric layer of thickness t separates the third and fourth patch layers. The first and fourth dielectric layers may be comprised of a flexible laminate such as liquid crystal polymer (LCP), PET (Dupont Mylar™), or PTFE. Dielectric layers may b formed of any electrically suitable material, including air.

In yet another aspect, the conductive posts are disposed to pass through apertures in the inductive grids, and thus may not electrically connect to the inductive grids. Similarly conductive posts may pass through junctions of the inductive grids, the junctions having apertures formed therein so that the posts may not electrically connect to the grid.

In a further aspect, the inductive grids may have a period that is half of the period P of the patches, or a period that is equal to or greater than the period P of the patches. Inductive grids with periods of P or greater may have enhanced inductance and allow passbands that have lower center frequencies as compared to similar radomes with a grid period of P/2.

In still another aspect, the equivalent shunt capacitance of the capacitive patch layers, the equivalent shunt inductance of the grid layers, the separation distance between inductive grids, and the separation distance between capacitive FSS layers and inductive grid layers, may be selected to provide a plurality of distinct frequency passbands.

A lower passband center frequency may be adjusted independently of an upper passband through the design of the inductive grids. Alternatively, the upper passband center frequency may be adjusted independently of the lower passband center frequency by controlling the separation between inductive grids.

A 3-pole bandpass characteristic may be obtained by using 6, 8, or 10 metal layers. A 6-layer structure may include two exterior capacitive layers two interior capacitive layers, and two inductive layers. The exterior capacitive layers may include an inter-digital finger arrangement to increase the effective shunt capacitance.

In another aspect, the radome may have 8 metal layers that may result in a 3-pole bandpass filter characteristic. Six of the metal layers may be capacitive patches arranged in overlapping patterns to form three shunt capacitors. The remaining two metal layers contain may inductive grids to form two shunt inductors.

A 3-pole FSR radome may include 10 metal layers that result in a 3-pole bandpass filter characteristic. Six of the metal layers may be capacitive patches arranged in overlapping patterns to form three shunt capacitors. The remaining four metal layers may contain inductive grids to form four shunt inductors.

The eight or ten layer 3-pole FSR may include a first and second patch layer disposed in relatively proximity to each other, a third and fourth patch layer disposed in proximity to each other, and a fifth and six patch layer also disposed in proximity to each other. A first dielectric region may be disposed between the second and third patch layers, where this dielectric region contains a parallel inductive grid. A second dielectric region may be disposed between the fourth and fifth patch layers, where second dielectric region also contains a parallel inductive grid.

The eight or ten layer 3-pole FSR may include an array of conducting posts that may connect the first patch layer to the sixth patch layer, and may further include a second array of conductive posts that connect the second patch layer to the fifth patch layer. The conductive posts form a rodded medium and the spatial period and dimensions of the conductive posts may suppress TM (transverse magnetic) surface wave modes over a desired band of frequencies. This desired band of frequencies may include the passband.

The periodic distance P' between conductive posts may exceed the period P between patches of the capacitive layers so as to broaden the TM mode surface wave stopband.

The conductive posts of the 3-pole FSR may be disposed to pass through apertures in the inductive grids and thus may electrically connect to the inductive grids.

DETAILED DESCRIPTION

Reference will now be made in detail to several examples; however, it will be understood that claimed invention is not limited to such examples. In the following description, numerous specific details are set forth in the examples in order to provide a thorough understanding of the subject matter of the claims which, however, may be practiced without some or all of these specific details. In other instances, well known process operations or structures have not been described in detail in order not to unnecessarily obscure the description.

When describing a particular example, the example may include a particular feature, structure, or characteristic, but every example may not necessarily include the particular feature, structure or characteristic. This should not be taken as a suggestion or implication that the features, structure or characteristics of two or more examples should not or could not be combined, except when such a combination is explicitly excluded. When a particular feature, structure, or characteristic is described in connection with an example, a person skilled in the art may give effect to such feature, structure or characteristic in connection with other examples, whether or not explicitly described.

Figure 1:
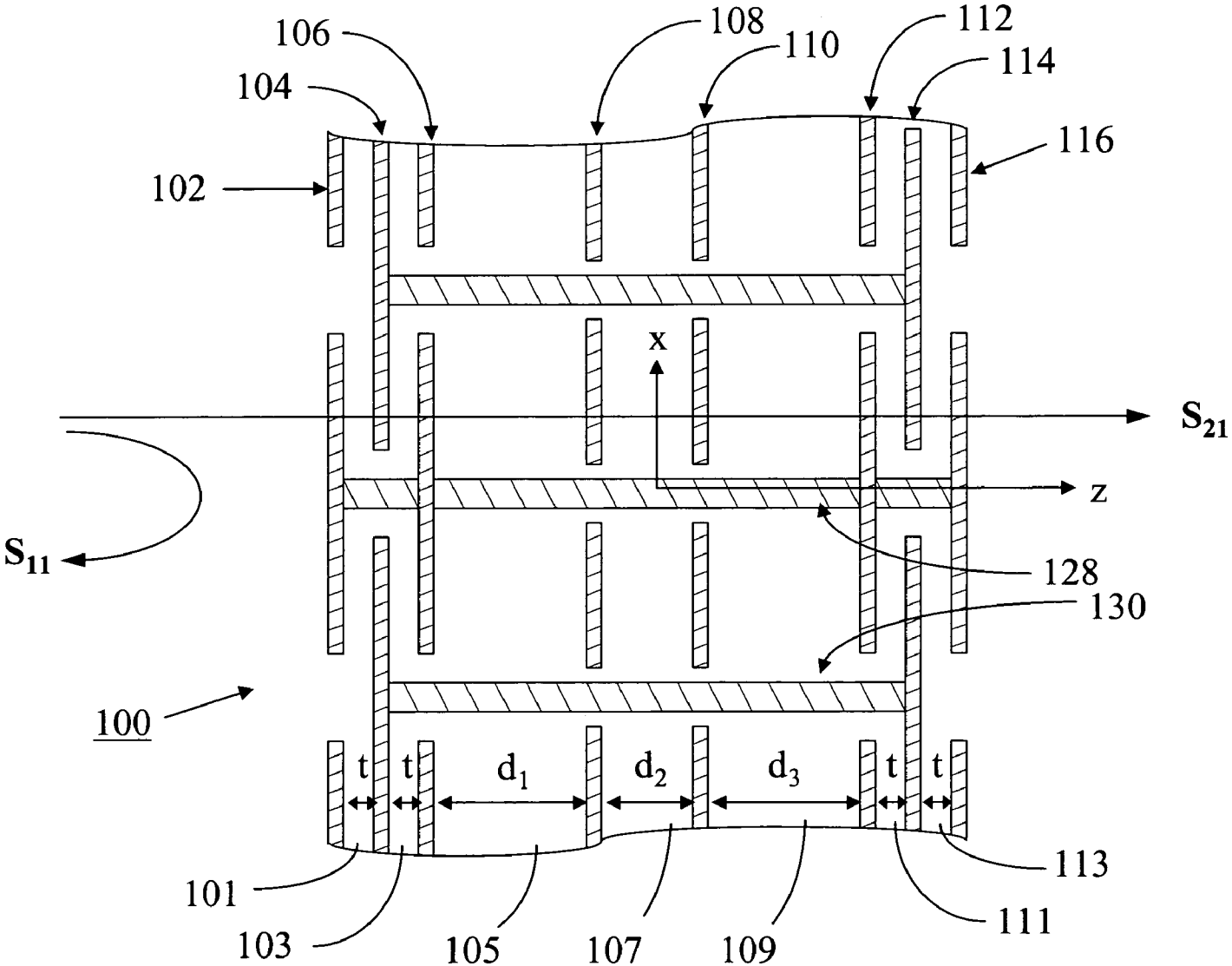
FIG. 1 shows an edge view of a bandpass radome as an eight layer stackup.

An example of an electrically-thin bandpass radome 100 is shown in FIG. 1. Bandpass radome or frequency selective radome (FSR) 100 is a multilayer structure which may be comprised of alternating conductive and dielectric layers. The layers having conductive components may be periodic in x and y directions and may be frequency selective surfaces (FSS) of either predominantly a capacitive type or predominantly an inductive type at frequencies within the electromagnetic bandpass. Conductive layers 102, 104, 106, 112, 114, and 116 are two-dimensional arrays of isolated patches which may be capacitive. Layers 108 and 110 are inductive and comprised of a two-dimensional periodic conductive grid. In the following description, the terms "inductive layer" and "inductive grid" will be used to represent the same concept. The structure periods of the inductive layers may be less than, equal to, or greater than the periods of the capacitive layers.

The capacitive layers 102, 104, and 106 are separated by dielectric layers 101 and 103 of thickness t. Capacitive layers 112, 114, and 116 are separated by dielectric layers 111 and 113 of thickness t. Capacitive layer 106 and inductive layer 108 are separated by a dielectric layer 105 of thickness $d_1$. Inductive layers 108 and 110 are separated from each other by a dielectric layer 107 of thickness $d_2$. Inductive layer 110 and capacitive layer 112 are separated by a dielectric layer 109 of thickness $d_3$. The thickness t may typically be substantially smaller than the thickness $d_1$ or $d_3$. For example, the value of the thickness t may typically range from about 1/50 to about 1/5 of the thickness $d_1$. In an example, the total radome thickness defined by $4t+d_1+d_2+d_3$ plus the thickness of all eight metal layers, may be in the range of approximately $\lambda/100$ to approximately $\lambda/30$ at the radome passband center frequency.

Individual dielectric layers 101, 103, 105, 107, 109, 111, and 113 may not be homogeneous dielectric regions. For example, each dielectric layer may be a core, a bonding layer such as a prepreg, or a combination of both types.

The bandpass radome 100 may also have arrays of conductive posts 128 and 130. These posts may connect to selected patches of the capacitive layers, and may connect to a central portion of such patches. The array of conductive posts 128, which may be periodic, may electrically connect to patches on layers 102, 106, 112, and 116. The periodic array of conductive posts 130 may electrically connect patches on layer 104 to patches on layer 114. As shown in FIG. 1, the inductive grids 108 and 110 are disposed so as to avoid electrical contact with both arrays of conductive posts 128 and 130. In this example, the inductive grids 108 and 110 are electrically isolated from the conductive posts. Alternatively, for example, the array of conductive posts 128 or 130 may be omitted.

There is no ground plane, such as is described in U.S. Pat. No. 6,476,771, "Electrically Thin Multi-Layer Bandpass Radome, issued to William E. McKinzie, III on Nov. 5, 2002, which is commonly assigned, and incorporated herein by reference. In the present examples, the inductive layer may not be directly connected to the conductive posts, and a slotted inductive grid may be used. Two inductive grids may be separated by a dielectric spacer layer 107, and an upper frequency transmission pole may be adjusted independently of a lower frequency transmission pole by varying the thickness of the spacer layer. Moreover, the lower transmission pole may be adjusted independently of the upper transmission pole by adjusting the inductance of the grids: for example, by varying the size of the apertures in the inductive grids.

For simplicity of analysis and design, radomes may often be designed and optimized for a desired passband center frequency assuming a normal angle of incidence)(0°) of the electromagnetic wave on the surface of the radome. However, it may be desirable that the passband be stable in frequency even with changes in the angle of incidence away from the normal. The periodic conductive posts form an anisotropic rodded medium which may make the electrical length of the equivalent transmission lines associated with dielectric layers 105, 107, and 109 fairly insensitive with respect to the angle of incidence. This may make the passband center frequency less sensitive to changes in angle of incidence.

In another aspect, the arrays of conductive posts 128 and 130 cut off parasitic TM surface-wave modes which may be excited at discontinuities such as edges of the radome surface. The arrays of conductive posts 128 and 130 may make the radome passband center frequency less sensitive to changes in angle of incidence.

The periodic array of conductive posts and patches within the radome forms an electromagnetic bandgap structure which may suppress TM mode surface waves along the radome structure. The TM mode has a normal (z-directed) component of electric field. A rodded medium with rods aligned in the z direction may cut off the dominant TEM mode (which has a z-directed electric field) from DC (direct current) to some cutoff upper frequency related to the rod diameter and spacing. TM modes in a surface waveguide (e.g., a bandpass radome structure) comprised of layers of rodded media may exhibit a negative effective dielectric constant for those layers. Such layers may be modeled as anisotropic effective media.

The term "effective media" will be understood by a person of skill in the art as being used to describe an equivalent homogeneous dielectric or magnetic media that is used in a numerical analysis or simulation to replace an inhomogeneous complex media, such as a periodic structure whose unit cell contains one or more dielectric regions and one or more metal regions. Dispersion equations for surface waves attached to this radome structure may be derived based on effective medium models. A surface wave analysis procedure is found in, "Design Methodology for Sievenpiper High-Impedance Surfaces: An Artificial Magnetic Conductor for Positive Gain Electrically Small Antennas," Clavijo, Diaz and McKinzie, IEEE Trans. Antennas and Propagation, Vol. 51, No. 10, October 2003. When the spacing between conductive posts, and the radius of the conductive posts, is sufficiently small, TM mode waves may be cut off for the passband frequency range or frequency ranges. The conductive posts may be connected to the patches of the capacitive layers for surface-wave suppression.

The bandpass radome 100 may be fabricated, for example, as a multilayer printed circuit board (PCB). The materials selected may determine whether the PCB acts as a flexible or a rigid structure. FIG. 1 illustrates an eight layer PCB where the number of layers refers to the number of conductive layers in the stackup. An even number of conductive layers, and a symmetrical arrangement of dielectric layers (in type and thickness) may be used to mitigate warping of the radome due to materials stresses. The arrays of conductive posts 128 and 130 may be, for example, plated vias. Although the conductive posts 130 in FIG. 1 are shown as blind vias, the vias may be, for example, plated thru holes. The thru holes may be counter bored if the length of the vial is less that the total board thickness.

The purpose of the capacitive layers is to realize a desired value of effective capacitance, $C_{fss}$, per unit square arising from the stored electrical energy between, for example, the patches of layers 102, 104, and 106. Energy is stored in the z-directed electric field between adjacent patches as in a parallel-plate capacitor. Energy is also stored in the fringing electric fields between adjacent edges of patches and may be termed edge capacitance. The parallel-plate capacitance may dominate the edge capacitance and, in some cases, the edge capacitance may be ignored in the design analysis.

The value of thickness t for dielectric layers 101, 103, 111, and 113 may be selected to be as small as practical so as to maximize $C_{fss}$ for a given patch size. Layers 112, 114, and 116 on the other side of the radome may also used to realize a desired effective capacitance per unit square. The symbol t is used to represent the thickness of a dielectric layer, but this does not require that all such layers be of the same thickness t.

Figure 2:
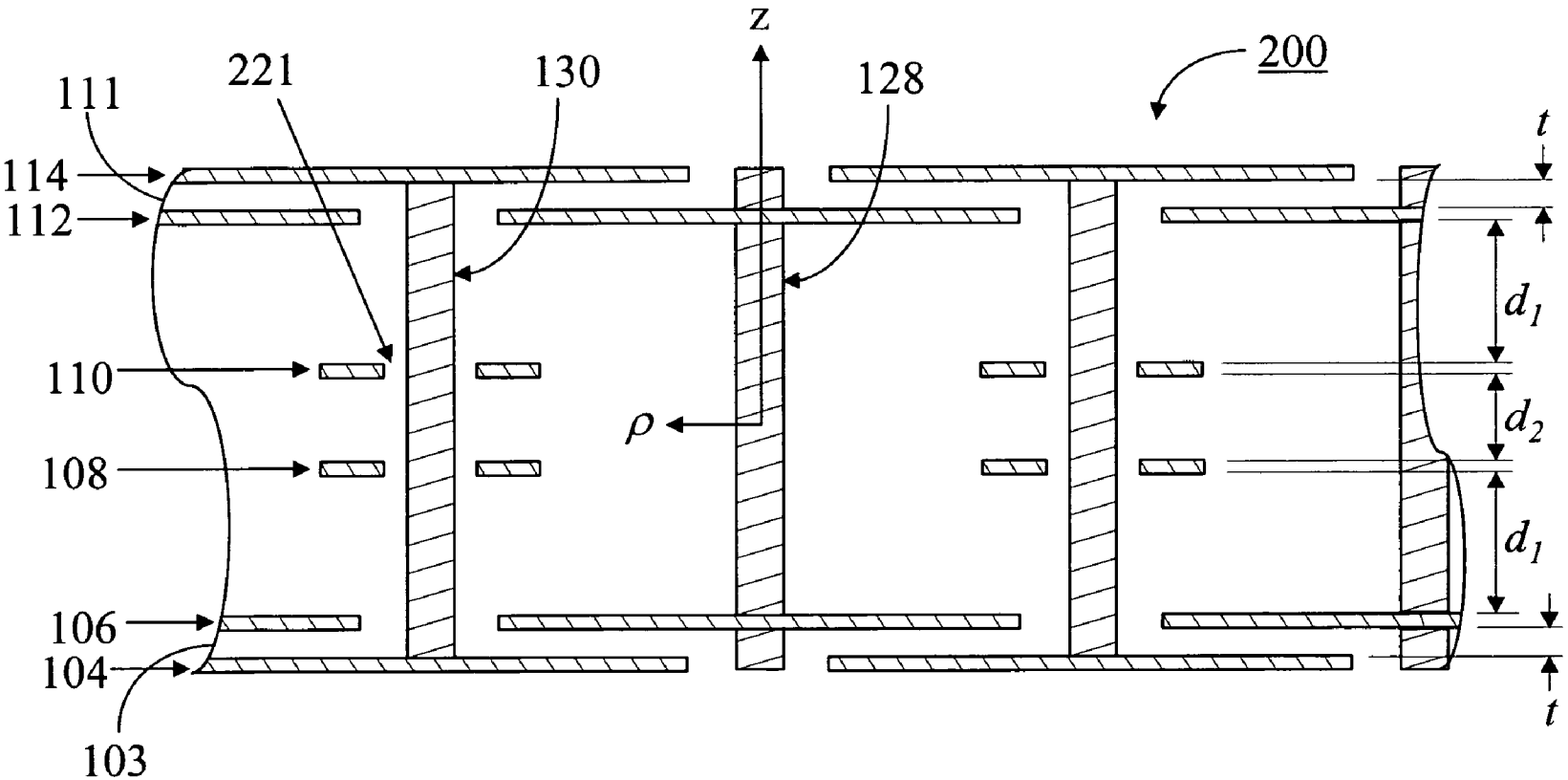
FIG. 2 shows an edge view of the bandpass radome as a symmetric six layer stackup.

The bandpass radome may have a greater or lesser number of capacitive layers than are shown in FIG. 1. For example, the exterior layers 102 and 116 may be omitted to realize lower values of effective capacitance $C_{fss}$ as shown in FIG. 2. In another example, some or all of the capacitive layers 102, 104, 114, and 116 may be omitted. In this embodiment, $C_{fss}$ is relatively small and dominated by edge capacitance. However, the edge capacitance may be increased by forming the patches of capacitive layers 106 and 112 into inter-digital fingers that couple to inter-digital fingers of adjacent coplanar patches.

FIG. 2 shows an example of a bandpass radome as a six-layer symmetric structure The dielectric layers 105 and 109 (not shown in FIG. 2, but disposed between layers 106 and 108 and 110 and 112, respectively) may be equal in thickness, $d_3=d_1$, and of a similar or the same material composition. This example is symmetrical about a plane parallel to the layers and disposed equidistant from the outer layers. Where the term "plane of symmetry" is used, it will be understood by persons of skill in the art that only a local region need be planar. A radome surface may have a radius of curvature or other shaped profile so long as the variation of curvature parameters is consistent with the operating wavelength. Capacitive layers 102 and 116 are omitted in this example.

Figure 3B:
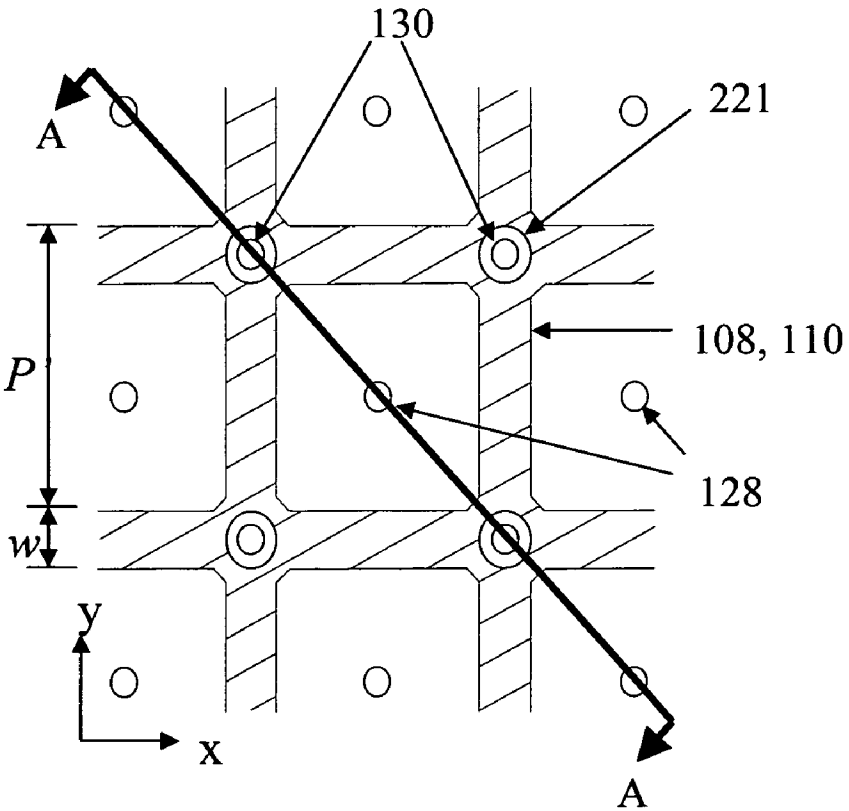
FIG. 3 shows (a) a plan view of the bandpass radome of FIG. 2 where only the conductive posts and patch layers are shown; and, (b) a plan view of the bandpass radome of FIG. 2 where only the conductive posts and inductive layers are shown.
Figure 3A:
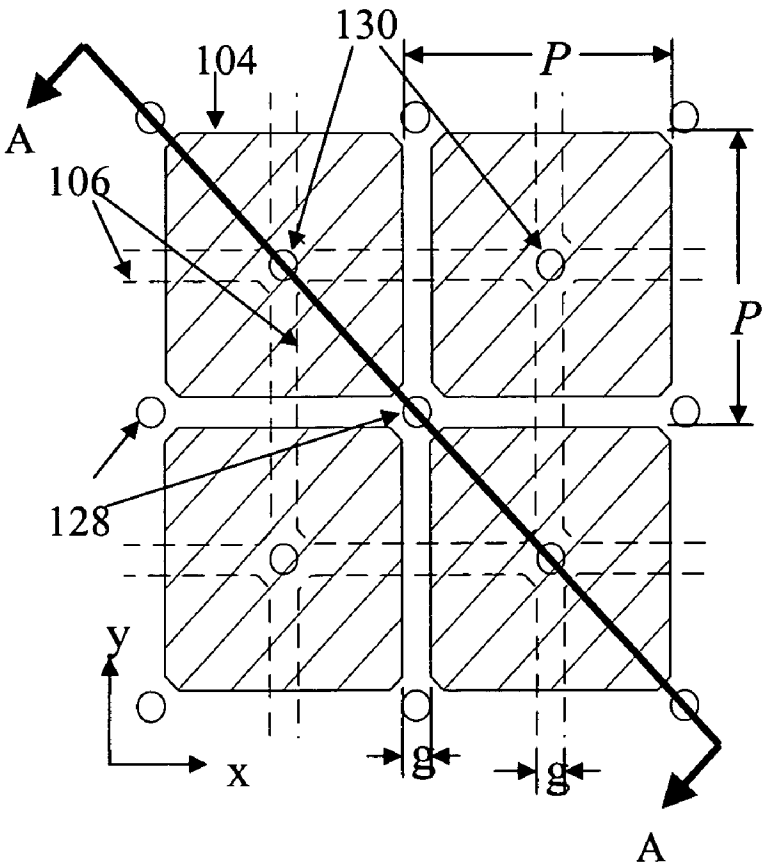

FIG. 2 is also a section view, section A-A, of FIGS. 3(*a*) and 3(*b*). The radial coordinate ρ corresponds to the radial direction from a via cut by the section line A-A.

FIG. 3(*a*) shows a plan view of the bandpass radome of FIG. 2, where only the arrays of conductive posts 128, 130 and capacitive layers 104, 106 are shown. Capacitive layers 114 and 112 may be the same as capacitive layers 104 and 106, respectively, and are not shown. Layer 104 is comprised of a periodic array of patches of period P in the x and y directions. Layer 106 is also comprised of a periodic array of patches of period P in the x and y directions, but offset by P/2 in the x and y directions with respect to layer 104. In this example, the patches of layers 104 and 106 are rebated at their corners so as to avoid contact with the conductive posts 128 and 130, as well as associated via pads. The conductive posts may be fabricated, for example, as plated vias. The rebated corners on the patches shown in FIG. 3(*a*) are mitered corners, but any shape may be used for rebating including a square cutout, a quarter circle, or the like. The effective capacitance of the surface may be estimated from:

$$C_{fss} \cong \frac{\varepsilon_r \varepsilon_o (P/2-g)^2}{t} \tag{1}$$

where g is the gap between patches, $\in_o$ is the permittivity of free space, and $\in_r$ is the relative dielectric constant of the dielectric layers 103 and 111. The dielectric layers separate the lower capacitive layers (104 and 106) and the upper capacitive layers (112 and 114). The patches 104 and 106 shown in FIG. 3(*a*) are essentially square, but the patches may take on any polygonal shape, even a circular shape, as long as sufficient effective capacitance is achieved.

FIG. 3(*b*) shows a plan view of the bandpass radome of FIG. 2, where only the arrays of conductive posts 128, 130 and the inductive grid layers 108, 110 are shown. Both inductive grids 108 and 110 may be substantially the same shape and are aligned with each other so that only one grid is visible in the plan view of FIG. 3(*b*). The inductive grids 108 and 110 are periodic in the x and y directions with period P', which is the same period as the patches. The grid traces have width w. A lower bound on the value of inductance of each grid may be computed from:

$$L_{grid} \geq \frac{\mu_o P'}{2\pi} \ln\left(\csc\left(\frac{\pi w}{2P'}\right)\right)\frac{(P'-w)}{P'} \tag{2}$$

where $\mu_o$ is the permeability of free space.

A more accurate grid inductance obtained by comparison of equivalent circuit models to full-wave electromagnetic simulations suggests that this formula for $L_{grid}$ may underestimate the inductance by 50% to 70%. This may arise as equation (2) was derived for isolated grids in free space, and the grids 108 and 110 are both capacitively and inductively coupled to each other due to close proximity.

The arrays of conductive posts 128 and 130 may not electrically connect to either inductive layer 108 or 110. The conductive posts 118 are located midway between the grids in the x and y directions. The posts 120 pass through the intersections of the grid "streets", but are isolated from the inductive grid by antipads 221, which are an absence of the conductive grid. The antipads 221 may be circular in shape as shown, square, or any convenient shape such that electrical isolation between the posts and grids is achieved.

Figure 4B:
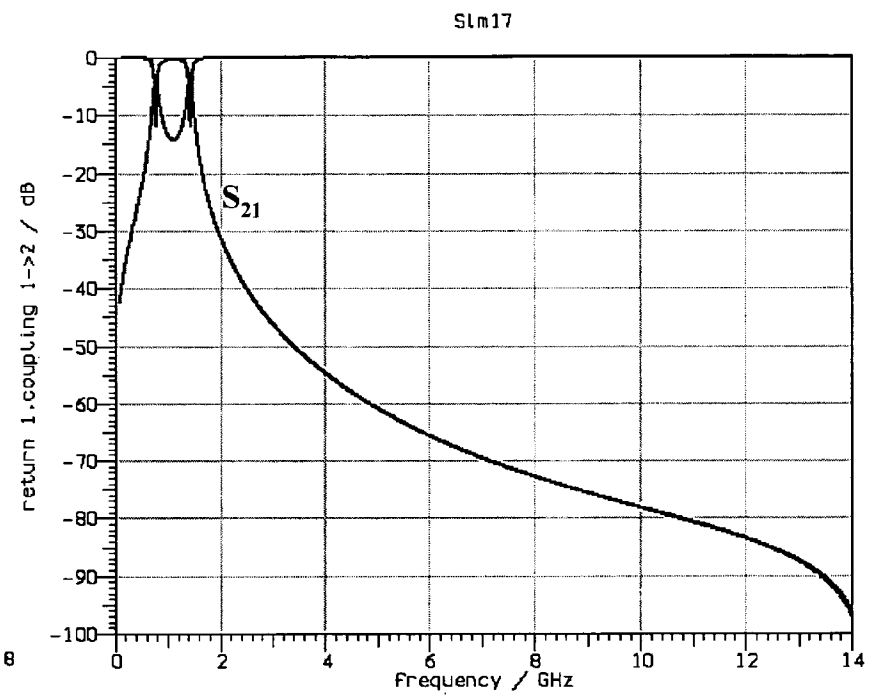
FIGS. 4 (*a*) and (b) illustrate the transmission ($S_{21}$) and reflection ($S_{11}$) plots for the bandpass radome of FIGS. 2 and 3.
Figure 4A:
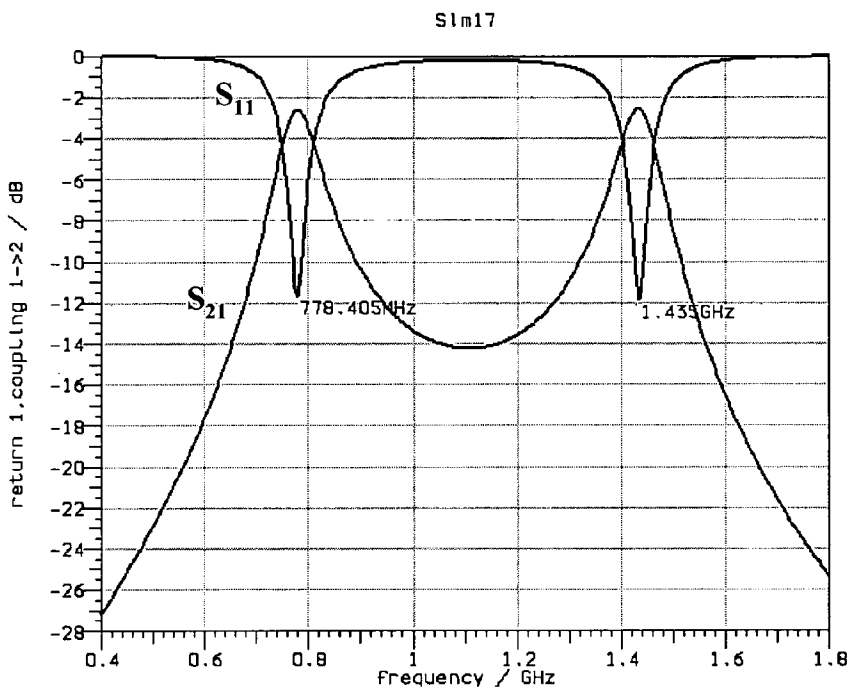

FIGS. 4(*a*) and 4(*b*) show an example of transmission ($S_{21}$) and reflection ($S_{11}$) plots at normal incidence for the bandpass radome of FIGS. 2 and 3. The S parameters were simulated using Microstripes™ version 7, a full-wave electromagnetic simulator marketed and licensed by Flomerics (Marlborough, Mass.). In this simulation, P=P'=8 mm, g=0.5 mm, $d_1$=1.25 mm, $d_2$=1 mm, t=0.05 mm, w=0.5 mm, and all vias are 0.5 mm diameter. The 0.5 mm wide "streets" of the grids intersect at conductive pads of 1.5 mm diameter. Concentric within each pad is a via of diameter 0.5 mm and an antipad of diameter 1 mm. The dielectric constant is $\in_r$=2.9 for layers 103 and 111, which may be realized, for example, using a flexible laminate of 2 mil Rogers RO3850 available from Rogers Corporation (Rogers, Conn.). This dielectric material is a liquid crystal polymer (LCP) material. Other choices of thin flexible laminates may also be used such as chemical compositions of PET (mylar) and PTFE (TEFLON). LCP and PTFE laminates may be suited for a radome application as they exhibit low loss tangents at RF frequencies, and are stable over varying temperature and humidity; however, other materials may be used, and new materials with suitable properties may be later developed. Dielectric layers 105, 107, and 109 were simulated using Rogers RO4003 laminate which has a relative dielectric constant of $\in_r$=3.38. Dielectric losses and conductor losses are both included, where copper is the conductor.

The $S_{21}$ plot shows two distinct passbands: one centered near 780 MHz, and another centered near 1430 MHz. The passbands are separated by a frequency ratio of about 1.8. This passband separation may be possible due to the relatively high inductance of the inductive layers 108 and 110. Reducing the grid inductance of layers 108 and 11 may move the passbands toward each other. The broadband $S_{21}$ plot of FIG. 4(*b*) shows that there are no spurious above-band responses in the simulation out to at least 14 GHz, which is at least a decade of frequency range above the highest passband frequency. The total thickness of the bandpass radome is only about 3.6 mm, ignoring the thickness of the thin metal layers. This thickness is approximately λ/58 at the center of the higher frequency passband, and approximately λ/107 at the center of the lower frequency passband.

The simulations show that certain design parameters may permit substantially independent control of the lower and upper passband center frequencies such that, for example:

(a) the lower passband center frequency may be adjusted substantially independently of the upper passband center frequency by varying the effective inductance of the inductive layers 108 and 110. For simplicity, the effective inductance may be equal for each layer. Increasing the effective inductance decreases the lower passband center frequency;

(b) the upper passband center frequency may be adjusted substantially independently of the lower passband center frequency by varying the distance $d_2$ between inductive grids 108 and 110. A larger separation distance $d_2$ moves the upper passband lower in frequency; and (c) both passband center frequencies may be increased or decreased in unison by either decreasing or increasing $C_{fss}$, respectively.

Figure 5B:
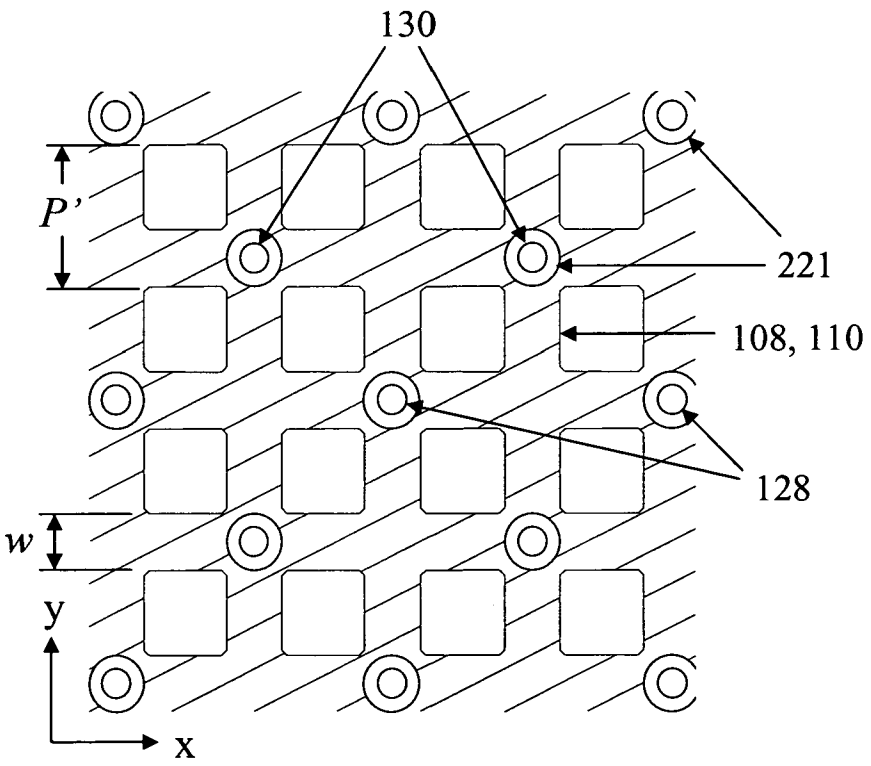
FIG. 5 shows (a) a plan view of the bandpass radome of FIG. 2 where only the conductive posts and patch layers are shown; and, (b) a plan view of another example of the bandpass radome of FIG. 2 where only the conductive posts and inductive layers are shown.
Figure 5A:
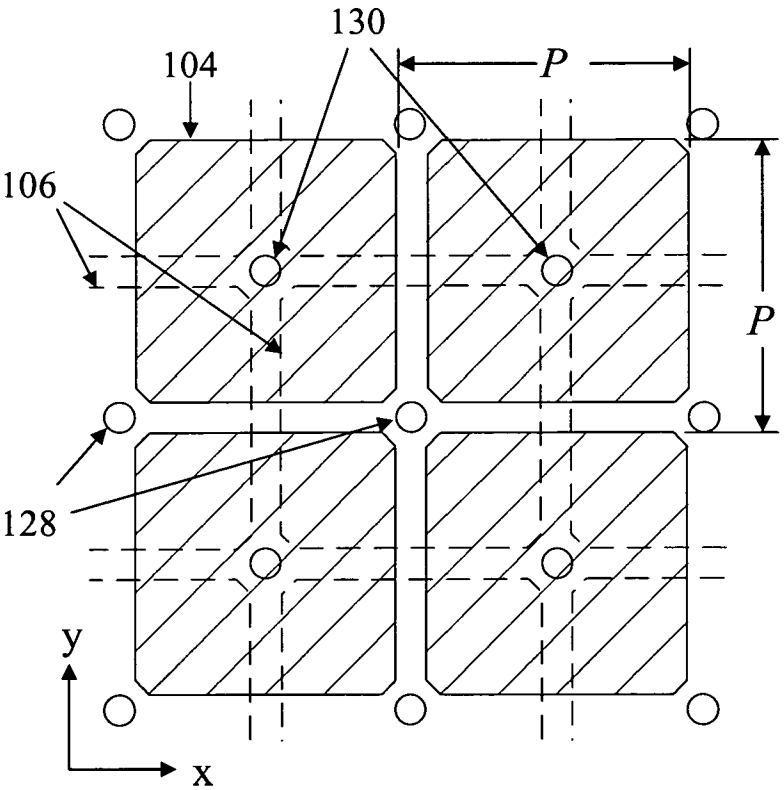

FIG. 5(*b*) shows another example of the bandpass radome of FIG. 2 where a lower value of inductance is used for the inductive layers 108 and 110. FIG. 5(*a*) repeats FIG. 3(*a*). FIG. 5(*b*) is a plan view of the inductive grids 108 and 110, and the arrays of conductive posts, 128 and 130. In this example, both inductive grids 108 and 110 may have the same shape and are aligned so that only one grid is visible in the plan view. The grids 108 and 110 are periodic in x and y directions with period P'=P/2 where P is the period of the patches in the x and y directions. The grid traces have a width w. The salient difference between this example and the example shown in FIG. 3(*b*) is that the inductive grids of FIG. 5(*b*) have a spatial period which is half of that of FIG. 3(*b*).

Antipads 221 electrically isolate the conductive posts from both inductive grids 108 and 110 where the posts penetrate the "streets" of the grids. In an alternative, the grids may be offset by P/4 in both the x and y directions, so that the conductive posts may pass through the apertures of the inductive layers.

Figure 6B:
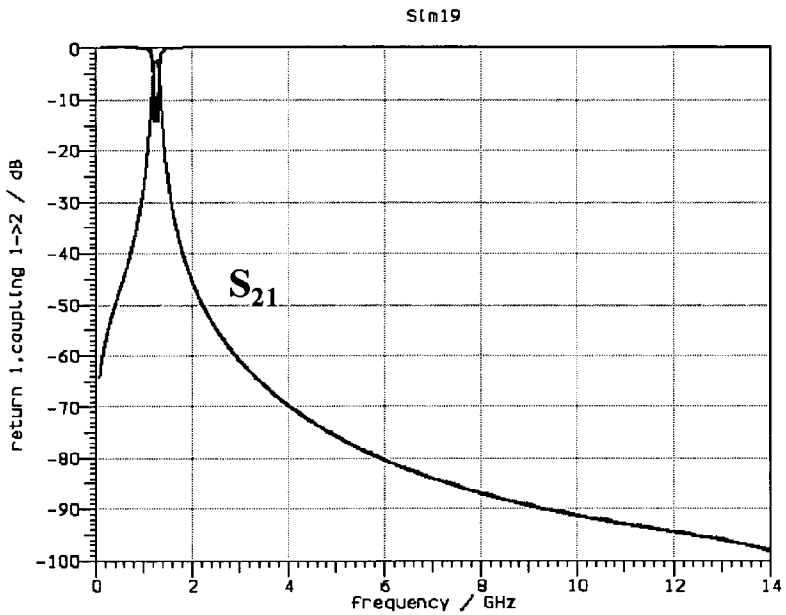
FIGS. 6 (*a*) and (*b*) illustrate the transmission ($S_{21}$) and reflection ($S_{11}$) plots for the bandpass radome of FIG. 5.
Figure 6A:
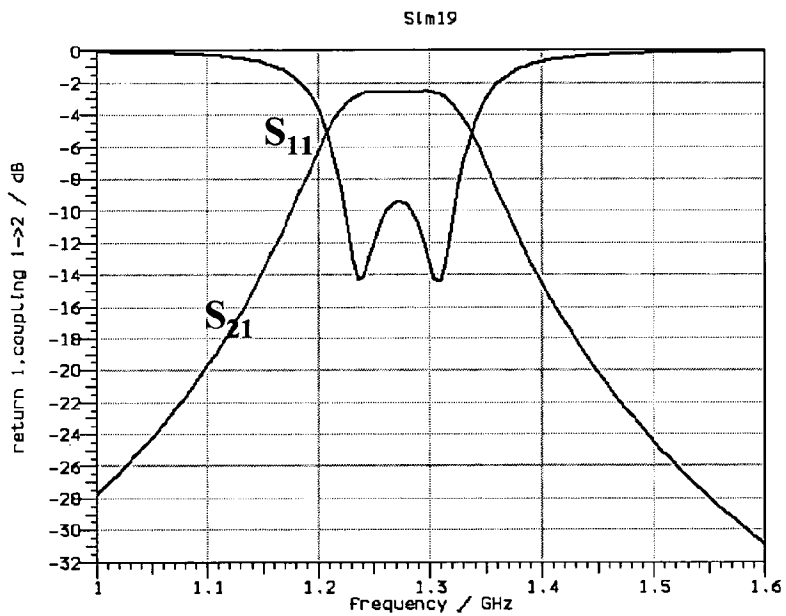

FIG. 6(*a*) shows the simulated transmission ($S_{21}$) and reflection ($S_{11}$) plots at normal incidence for an example of the bandpass radome of FIGS. 2 and 5. In this example, P=8 mm, P'=4 mm, g=0.5 mm, $d_1$=1.524 mm, $d_2$=1 mm, t=0.05 mm, w=1.25 mm, and all conductive posts are 0.5 mm diameter vias. As with the previous example simulation, dielectric layers 103 and 111 are modeled as 2 mil Rogers RO3850 LCP. Dielectric layers 105, 107, and 109 are modeled as Rogers RO4003.

The previously distinct passbands have coalesced into one broader passband, centered near 1275 MHz, which may be a result of the reduction in grid inductance. The broadband $S_{21}$ plot of FIG. 6(*b*) shows that there are no spurious responses in the simulated results out to at least 14 GHz, which is at least a decade in frequency range above the highest passband frequency. The total thickness of this embodiment of the bandpass radome is about 4.148 mm, ignoring the metal thickness, which is equivalent to approximately $\lambda/56$ thick at the center of the passband.

Figure 7B:
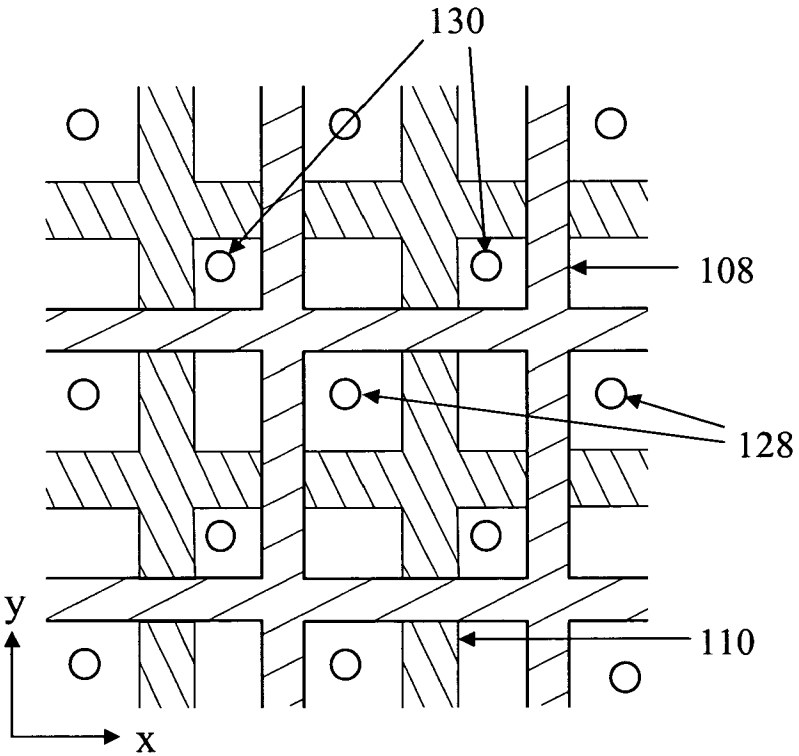
FIG. 7 shows (a) another example of the inductive layers of the bandpass radome of FIG. 2 where the layers are comprised of aligned grids; and (b) another example of the inductive layers of the bandpass radome of FIG. 2 where the layers are comprised of staggered grids.
Figure 7A:
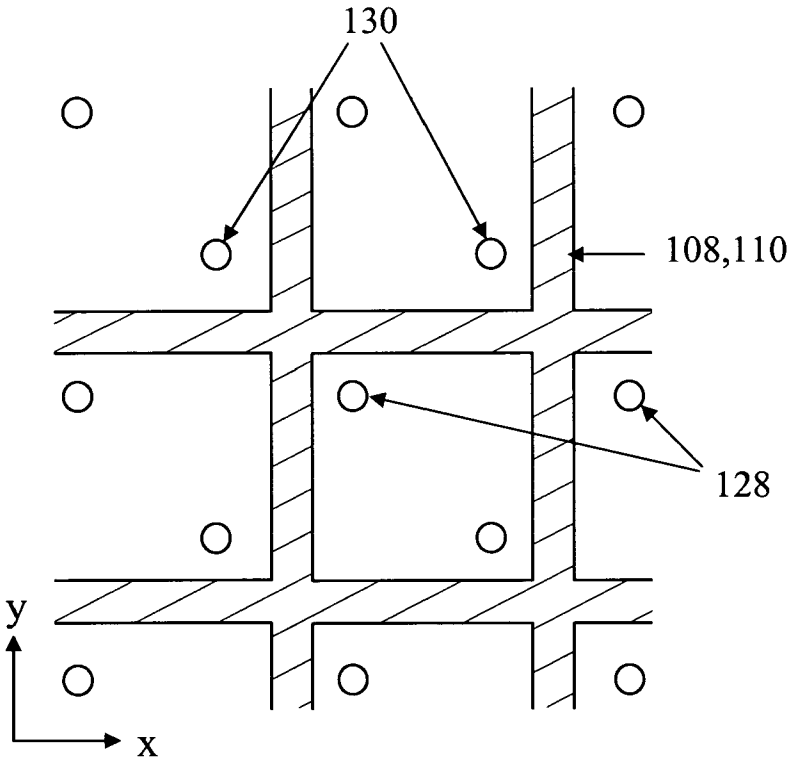

In another aspect, FIG. 7(*a*) shows a plan view of an example of the inductive grid layers of FIG. 2 where the inductive layers are comprised of aligned grids 108 and 110. Only one grid is shown since, for simplicity, both grids are assumed to have the same width. The inductive grids may have a period of P equal to the patch period. The grid traces are positioned to run between arrays of conductive posts 118 and 120 so as to avoid electrical contact therebetween. FIG. 7(*b*) shows a similar plan view where one of the inductive grids 110 has been offset in the x and y directions by one-half of the grid period, resulting in a staggered set of grid streets. The inductive grids 108 and 110 are routed between the arrays of conductive posts 128 and 130 so as to avoid electrical contact.

Figure 8:
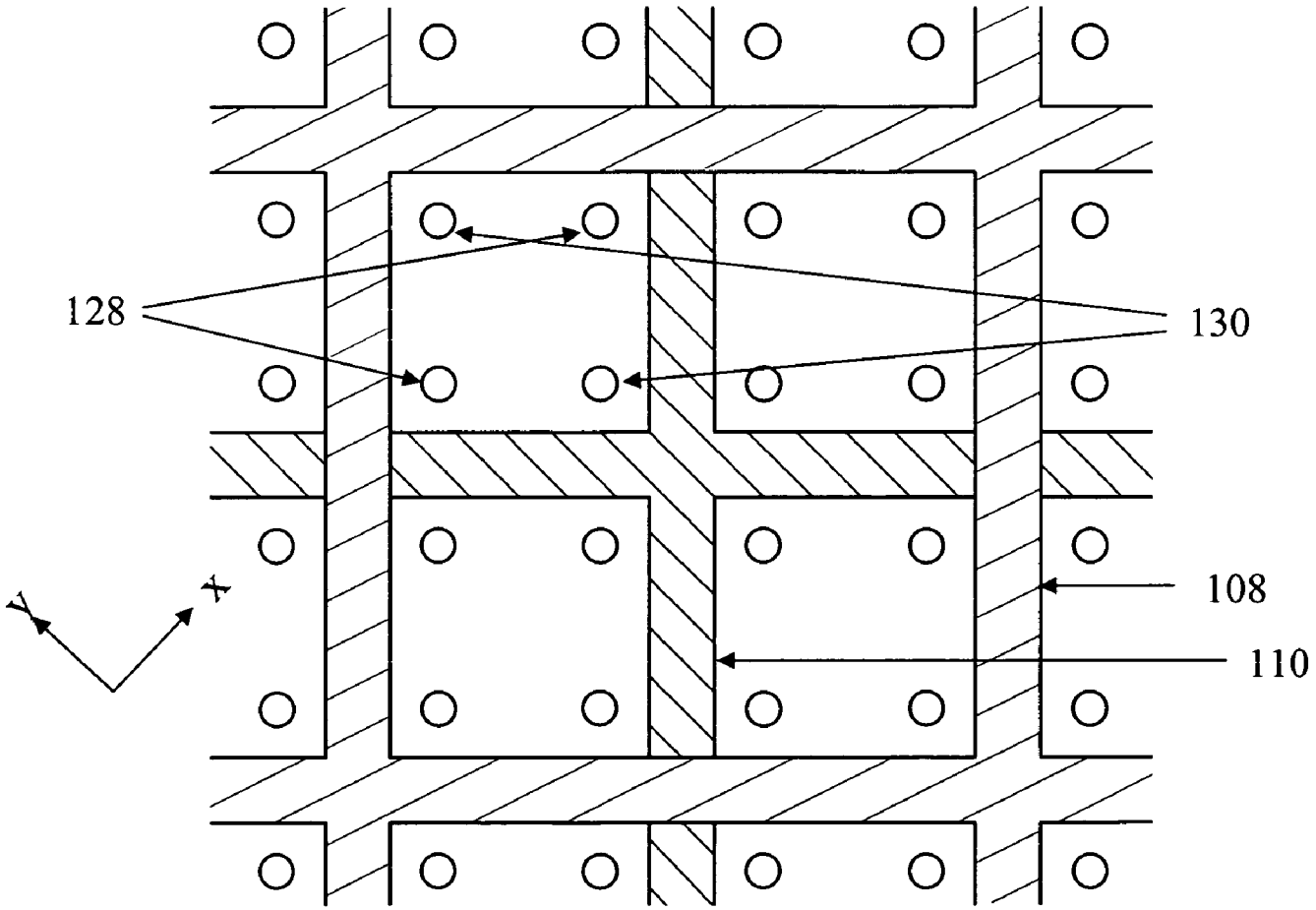
FIG. 8 shows yet another example of the inductive layers of the bandpass radome of FIG. 2.

FIG. 8 shows yet another example of possible inductive grid designs, where the "streets" of the inductive grids 108 and 110 have been rotated by 45° with respect to the x and y coordinate axes. This orientation allows more space to run the grid streets between arrays of conductive posts 118 and 120. As with the example of FIG. 7(*b*), the grids are staggered horizontally, although this is not necessary. The period P' of the grids 108 and 110 exceeds the period of patches P, which is the distance between collinear posts in the x or y direction.

FIGS. 1 and 2 show two inductive layers disposed near the center of the radome. This configuration permits an even number of layers for the entire stackup, but is not necessary. For example, either the inductive layer 108 or the inductive layer 110 may be omitted. The capacitive layers may be an odd number.

Figure 9:
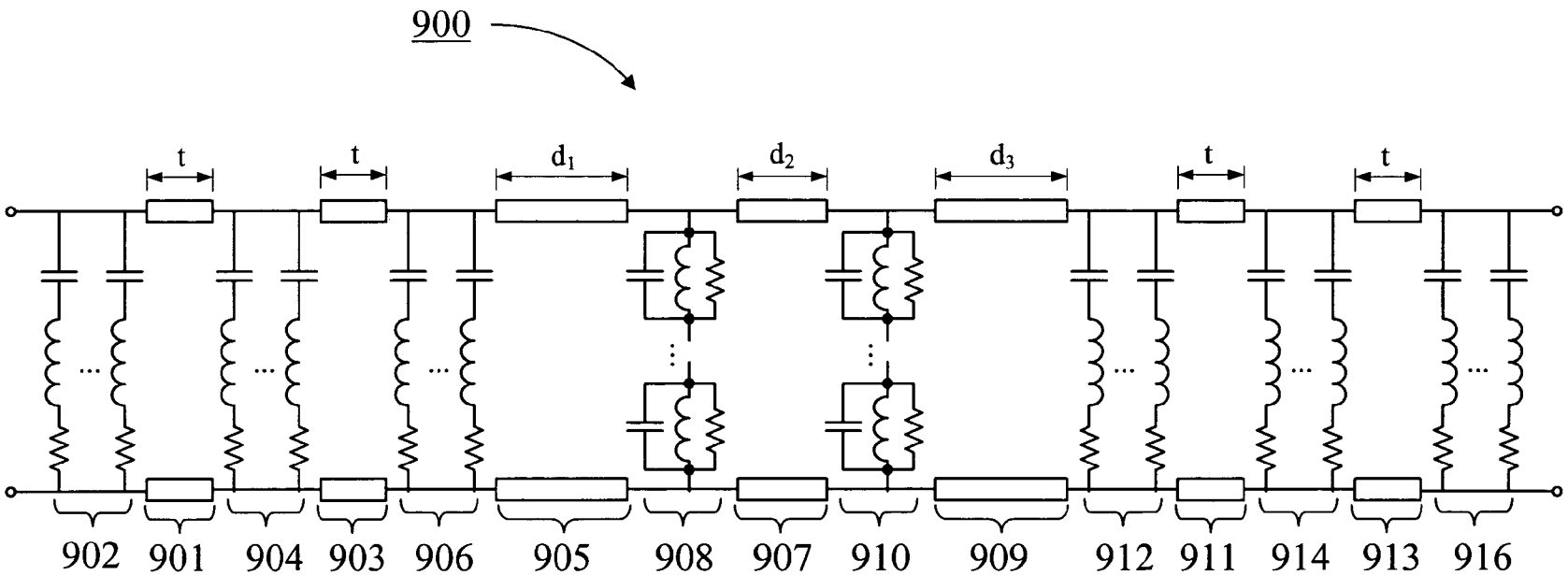
FIG. 9 is an equivalent circuit model of the bandpass radome of FIG. 1 for angles near normal incidence.

The performance of the bandpass radome 100 may be understood using equivalent circuit models instead of full-wave electromagnetic simulations. FIG. 9 shows a multi-resonance equivalent circuit model 900 of the bandpass radome 100 for angles near normal incidence. In the circuit model 900, the capacitive layers 102, 104, 106, 112, 114, and 116 are modeled as equivalent circuits 902, 904, 906, 912, 914, and 916 respectively. The topology of these equivalent circuits is a plurality of series RLC networks, connected in parallel. Each equivalent circuit is used to model the broadband behavior of a given capacitive layer. For each capacitive layer, the number of branches and the RLC values may be different.

In the circuit model 900, the inductive layers 108 and 110 are modeled as equivalent circuits 908 and 910. The topology of these equivalent circuits is a sequence of parallel RLC circuits connected in series. This series combination is connected in shunt across the equivalent TEM mode transmission line at the location of the inductive grid. In general, for each inductive layer, the number of parallel RLC circuits and the RLC values may be different.

In the circuit model 900, the transmission lines 901, 903, 905, 907, 909, 911, and 913 model a TEM mode traveling through dielectric layers 101, 103, 105, 107, 109, 111, and 113 respectively. The modeled lengths of the transmission lines are the same as the thickness of each corresponding dielectric layer. The characteristic impedances of the transmission lines are modeled as $\sqrt{\mu_o/(\epsilon_o\epsilon_r)}$ where $\epsilon_r$ is the relative dielectric constant of each dielectric layer.

The equivalent circuits of 902, 904, 906, 908, 910, 912, 914, and 916 are each shown as a sequence of RLC resonators (either series or parallel resonators). These resonators are used to model the multiple resonances of the layers, where each RLC resonator models one resonance. In most cases, a layer is designed to be used in a frequency range where only one of these resonances may be expected to occur. In the radome examples described herein, the passbands are generally substantially lower in frequency than the resonant frequencies of the individual layers, and the multi-resonator equivalent circuit 900 may be simplified.

Figure 10A:
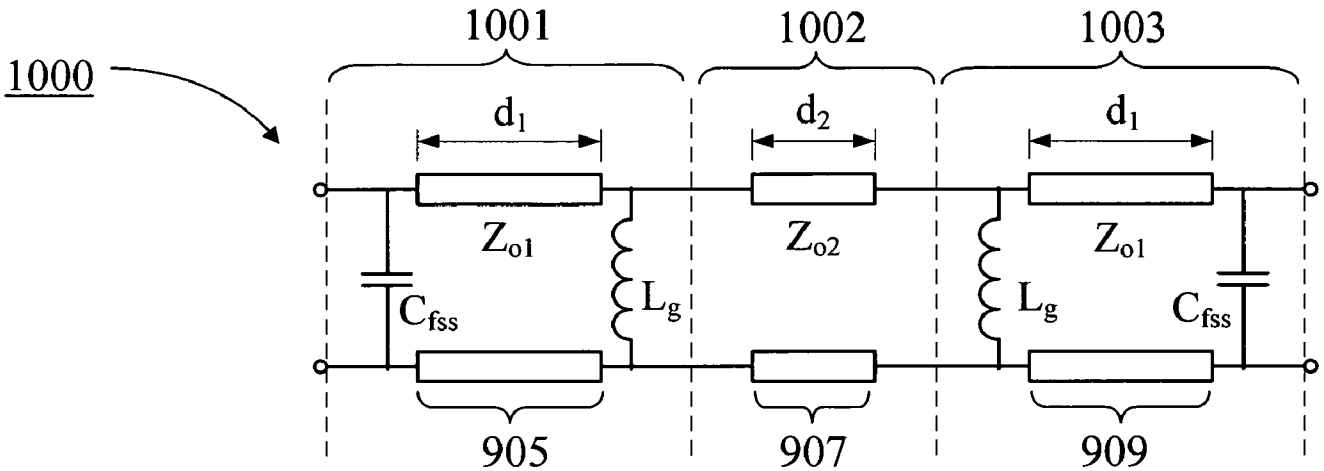
FIGS. 10 (*a*) and (*b*) are an equivalent circuit model of the bandpass radome of FIG. 1 or 2 for a symmetrically fabricated radome, for angles near normal incidence.
Figure 10B:
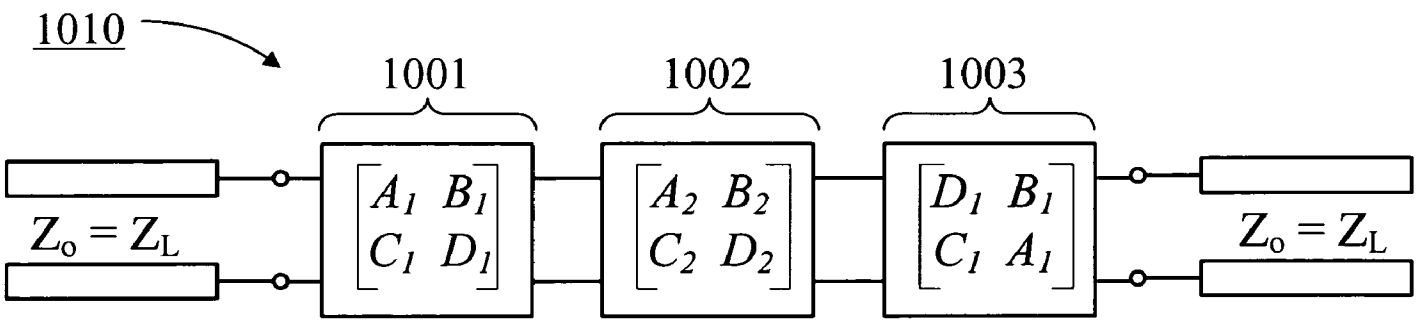

FIG. 10(*a*) shows one such simplified equivalent circuit model 1000 of the bandpass radome of FIG. 1 or 2 for a symmetrically fabricated radome and angles near normal incidence. In the equivalent circuit 1000, the shunt capacitance $C_{fss}$ is a simplified equivalent circuit of 901, 902, 903, 904, and 906. This simplification may be appreciated as replacing the multiple series RLC networks of a given capacitive layer by one series network to model the dominant resonance. When operating far below this resonance, the one series inductance may be eliminated. Since the capacitive layers are typically copper (Cu) or some other highly conductive material, the series resistance in each layer may be eliminated from the model. As the period of the capacitive patches is less than a free space wavelength $\lambda$, grating lobe losses are absent. Since the transmission lines 901 and 903 are electrically short at the passband frequencies, on the order of $\lambda/400$ or less, the transmission line may be replaced with direct connections of zero length. This allows combination of parallel shunt capacitive networks into one net shunt capacitance of value $C_{fss}$. These considerations may result in the reduction of equivalent circuits 911, 912, 913, 914, and 916 into a shunt capacitance of $C_{fss}$.

In the equivalent circuit 1000, the shunt inductance $L_g$ is the simplified equivalent circuit of networks 908 or 910. One parallel RLC resonator may dominate and, far below the resonance thereof, the parallel capacitor may be eliminated in the model. The losses of the inductive layers may be negligible assuming good conductors, permitting the elimination of the parallel resistor in 908 and 910. The remaining component is the parallel inductance denoted as $L_g$ in FIG. 10(*a*).

The equivalent circuit 1000 is sufficiently simplified to permit closed-form analysis of its transmission performance $S_{21}$. Closed-form expressions are useful when one wishes to perform parametric studies of design variables or to optimize design parameters. The design may be refined or confirmed using full wave analysis.

The equivalent circuit 1000 may be analyzed by segmenting it into three cascaded subcircuits denoted as 1001, 1002, and 1003. The approach is to model each subcircuit with an ABCD matrix. FIG. 10(*b*) shows an equivalent network representation 1010 for the symmetric radome where each of the three subcircuits 1001, 1002, and 1003 have the ABCD matrices shown. Subcircuits 1001 and 1003 are the same, but the ports are reversed. That is, the ABCD parameters for subcircuits 1001 and 1003 contain the same elements but are rearranged. The ABCD parameters may be expressed as:

$$A_1 = \cos(\beta_1 d_1) + \frac{Z_{o1}}{\omega L_g}\sin(\beta_1 d_1) \tag{3}$$

$$B_1 = jZ_{o1}\sin(\beta_1 d_3) \tag{4}$$

$$C_1 = \left(j\omega C_{fss} + \frac{1}{j\omega L_g}\right)\cos(\beta_1 d_1) + j\left(\frac{1}{Z_{o1}} + \frac{C_{fss}}{L_g}Z_{o1}\right)\sin(\beta_1 d_1) \tag{5}$$

$$D_1 = \cos(\beta_1 d_1) - \omega C_{fss} Z_{o1}\sin(\beta_1 d_1) \tag{6}$$

$$A_2 = \cos(\beta_2 d_2) \tag{7}$$

$$B_2 = jZ_{o2}\sin(\beta_2 d_2) \tag{8}$$

$$C_2 = \frac{j}{Z_{o2}}\sin(\beta_2 d_2) \tag{9}$$

$$D_2 = \cos(\beta_2 d_2) \tag{10}$$

Matrix multiplication of the ABCD parameters for each subcircuit, followed by the substitution of $D_2=A_2$, yields the ABCD parameters for the entire radome:

$$A = A_1A_2D_1 + D_1B_1C_2 + A_1B_2C_1 + A_2B_1C_1 \tag{11}$$

$$B = A_1(A_1B_2 + A_2B_1) + B_1^2C_2 + A_1^2B_2 \tag{12}$$

$$C = B_2C_1^2 + D_1A_2(2C_1 + C_2) \tag{13}$$

$$D = A. \tag{14}$$

Finally, the transmission response in dB for this symmetric radome may be expressed as $$S_{21} = -20\log\left\{\left|\frac{1}{2}\left(2A + \frac{B}{Z_L} + Z_L C\right)\right|\right\}(d\beta). \tag{15}$$

$Z_L$ is the wave impedance of free space, 377Ω.

The previous examples have illustrated the capacitive and inductive layers as isotropic patterns having equal equivalent circuits for electromagnetic waves polarized in both x and y directions. This may result in dual-polarized radomes with equal performance for both polarizations. However, anisotropic layers may be used such that the passbands may differ in center frequency as a function of polarization.

The previous examples have a passband performance which may be described as a 2-pole response, where two distinct frequencies are associated with peaks in the transmission response $S_{21}$. Electrically thin bandpass radomes may also be configured, for example, for a 3-pole response characteristic. A 3-pole response radome may have a broader passband, typically about 10% to 16% bandwidth, and a larger filter shape factor, for better frequency selectivity.

Figure 11:
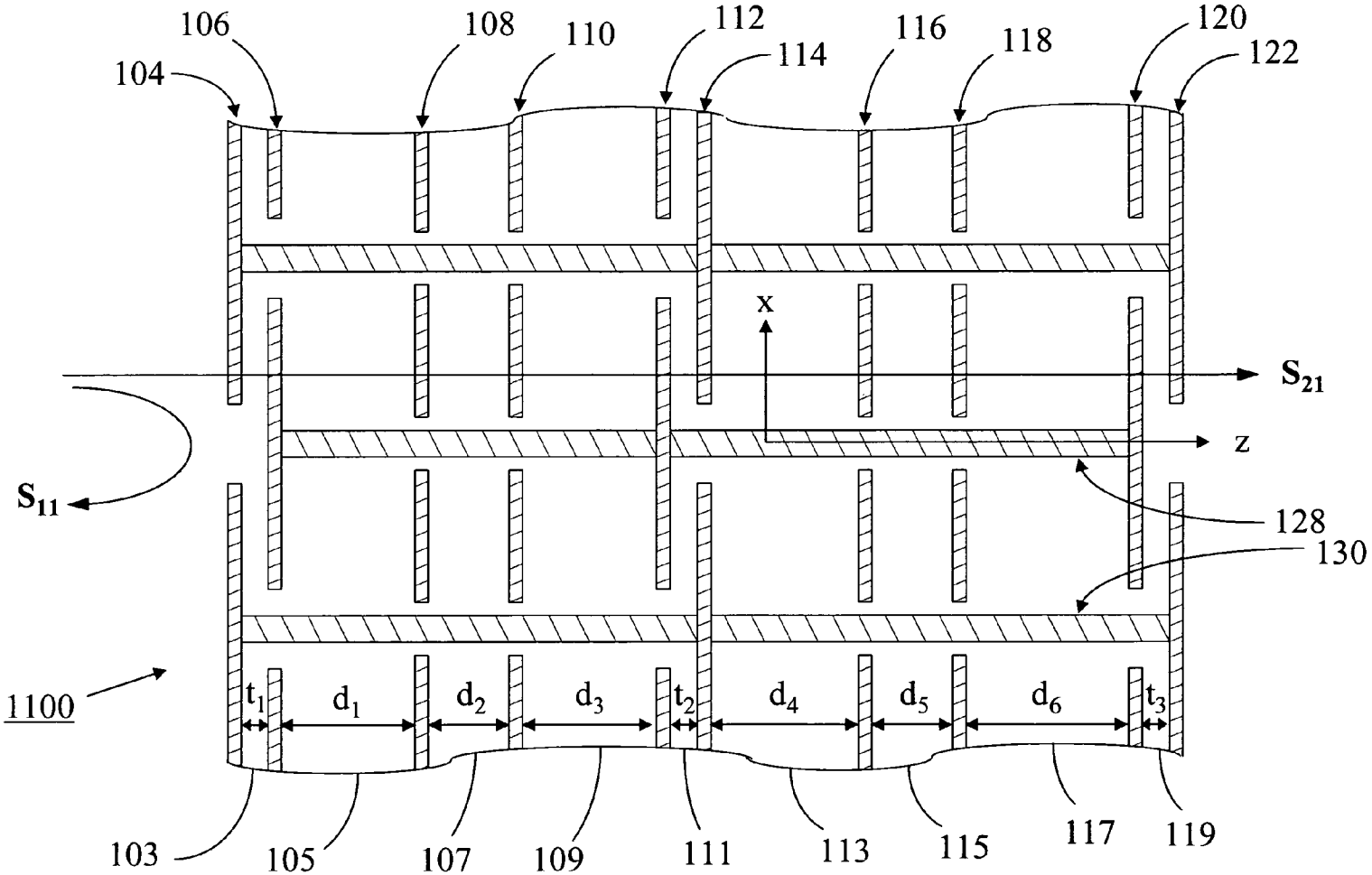
FIG. 11 shows an edge view of a 3-pole bandpass radome as a ten layer stackup.

An example of a 3-pole response bandpass radome 1100 is shown in FIG. 11. The features in the transverse (x and y) directions may be similar to the 2-pole examples, however, the stackup in the z direction may be more complex. Layers 104, 106, 112, 114, 120, and 122 are capacitive layers comprised of two-dimensional arrays of isolated patches. Layers 108, 110, 116, and 118 are inductive layers and may be comprised of two-dimensional periodic grids. The structure periods of the inductive layers may be less than, equal to, or greater than the periods of the capacitive layers. In addition, the periods of the capacitive layers may not be uniform. For instance, layers 104, 106, 120, and 122 may have patch arrays with a smaller period than the patch arrays on the interior layers 112 and 114.

In radome 1100, capacitive layers 104 and 106 are separated by a dielectric layer 103 of thickness $t_1$. Capacitive layers 112 and 114 are separated by a dielectric layer 111 of thickness $t_2$. Capacitive layers 120 and 122 are separated by a dielectric layer 119 of thickness $t_3$. Dielectric layers 105, 107, and 109 space the two inductive layers 108 and 110 at pre-selected distances between capacitive layers 106 and 112. Inductive layers 108 and 110 are spaced a distance $d_2$ apart, layers 106 and 108 are separated by a distance $d_1$, and layers 110 and 112 are separated by a distance $d_3$. Similarly, dielectric layers 113, 115, and 117 space the two inductive layers 116 and 118 at pre-selected distances between capacitive layers 114 and 120. Inductive layers 116 and 118 are spaced a distance $d_5$ apart, layers 114 and 116 are separated by a distance $d_4$, and layers 118 and 120 are separated by a distance $d_6$. The thicknesses $t_1$, $t_2$, and $t_3$ may typically range from about 1/50 to 1/5 of the dimensions of $d_1$ thru $d_6$. In an example, the total radome thickness defined as $t_1+t_2+t_3+d_1+d_2+d_3+d_4+d_5+d_6$, plus the thickness of all ten metal layers, may be in the range of approximately λ/150 to λ/10 at the radome passband center frequency, where λ, is the free-space wavelength.

Bandpass radome 1100 may also have arrays of conductive posts 128 and 130, similar to conductive posts 128 and 130 of FIGS. 1 through 8. These posts may connect to capacitive layers, and they may connect to a central region of patches on capacitive layers. The posts 128 and 130 may or may not contact the conductive patches on capacitive layers 112 and 114. As with the previous 2-pole response examples, the conductive posts 128 and 130 may be disposed so as to avoid electrical contact with conductors on inductive layers 108, 110, 116, and 118. The arrays of conductive posts 128 and 130, which may be periodic, may electrically connect patches which reside on opposite sides of the radome. The periodic array of conductive posts 130 connects conductive patches on capacitive layer 104 to conductive patches on capacitive layer 122. The periodic array of conductive posts 128 may connect conductive patches on capacitive layer 106 to conductive patches on capacitive layer 120. The arrays of conductive posts may create a TM mode surface-wave stopband. One of the arrays of posts may be omitted to lower the stopband frequency range. The period of the array of posts 128 and 130 may exceed the period of the patches on corresponding capacitive layers resulting in some of the patches on these capacitive layers being isolated by not being connected to a post.

When connecting capacitive layers to arrays of conductive posts, the ordering of the exterior capacitive layers may not be significant. For example, in the 3-pole FSR of FIG. 11, layer 104 may be connected to layer 120, and layer 106 may be connected to layer 122. For the 2-pole FSR of FIG. 2, layer 104 may be connected to layer 112, and layer 106 may be connected to layer 114. A rodded medium (array of posts) may terminate on whatever capacitive layers combine to form the exterior shunt capacitance.

Individual dielectric layers 103, 105, 107, 109, 111, 113, 115, 117, and 119 in radome 1100 need not be homogeneous dielectric regions. A layer, for example, may be a core, prepreg, a bonding layer, or a combination thereof. Dielectric layers may be isotropic or anisotropic, as with honeycomb materials.

The 3-pole radome 1100 may be fabricated as a multi-layer printed circuit board. The 10 metal layer structure of FIG. 11 may be fabricated as a mechanically-balanced structure where $t_1=t_3$, $d_1=d_6$, $d_2=d_5$, $d_3=d_4$, and a plane of symmetry would exist midway between capacitive layers 112 and 114. The conductive posts may be, for example, plated vias.

Figure 12:
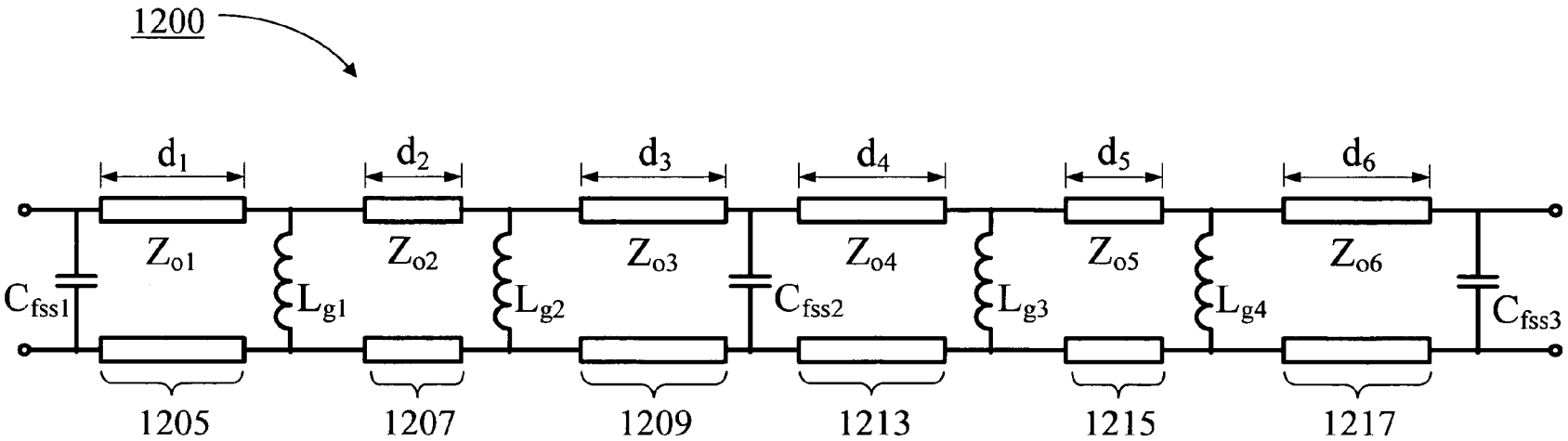
FIG. 12 is an approximate equivalent circuit model of the bandpass radome of FIG. 11 for angles near normal incidence.

A simplified equivalent circuit 1200 for radome 1100 is shown in FIG. 12. This equivalent circuit may be appropriate for relatively low frequencies such as in the passband frequency range, and for angles of incidence near normal. Capacitive layers 104 and 106 are modeled as a shunt capacitor $C_{fss1}$. Capacitive layers 112 and 114 are modeled as a shunt capacitor $C_{fss2}$. Capacitive layers 120 and 122 are modeled as a shunt capacitor $C_{fss3}$. Inductive layers 108, 110, 116, and 118 are modeled as shunt inductances $L_{g1}$, $L_{g2}$, $L_{g3}$, and $L_{g4}$ respectively. Transmission lines 1205, 1207, 1209, 1213, 1215, and 1217 model plane waves traveling through dielectric layers 105, 107, 109, 113, 115, and 117, respectively. These transmission lines are modeled as having the same physical length as the corresponding dielectric regions. Characteristic impedances are modeled in the same manner as discussed for the 2-pole radome example.

Higher order bandpass filters may be realized, for example, by adding alternating inductive and capacitive layers to the stackup of lower-order bandpass filters.

Figure 13:
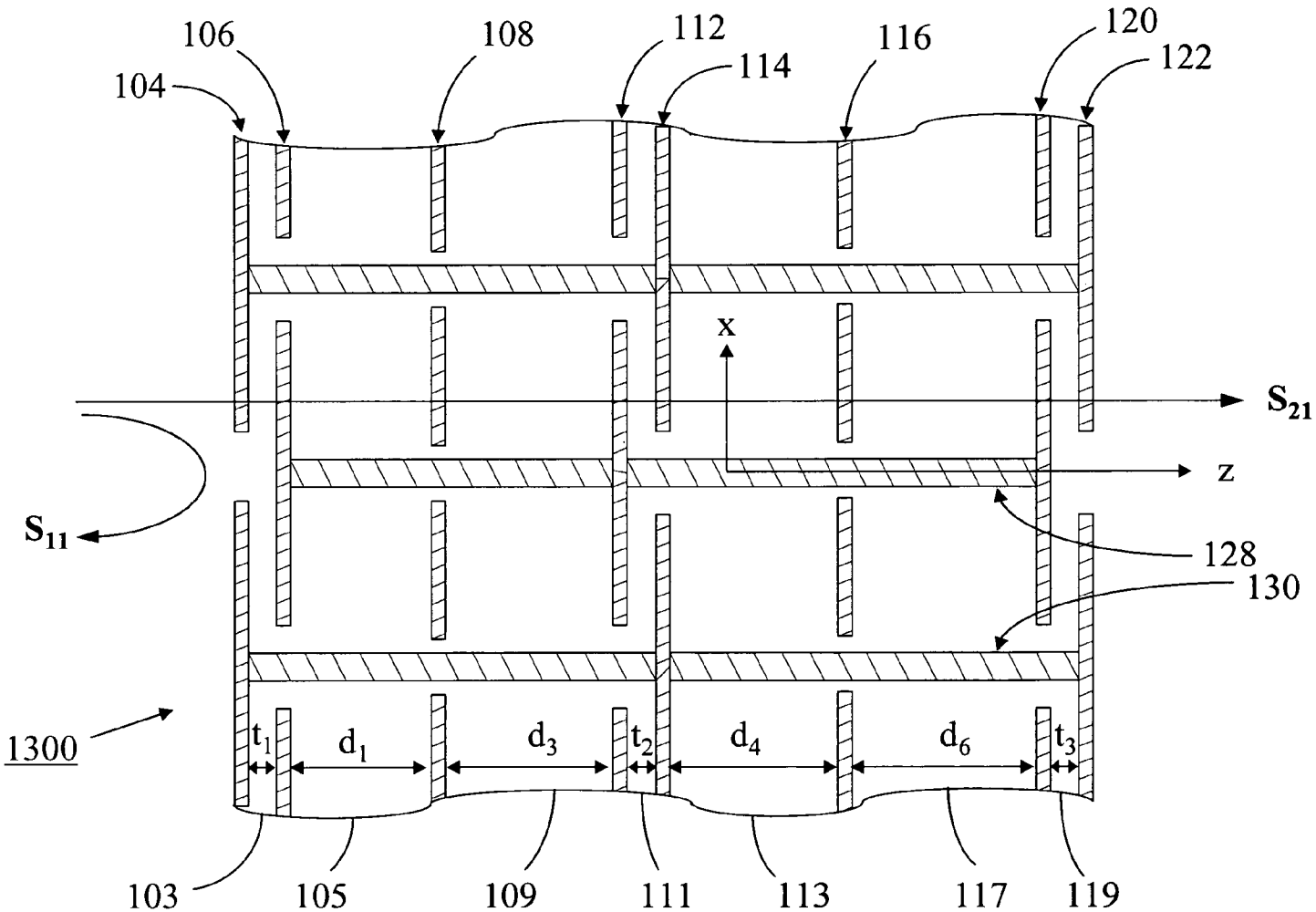
FIG. 13 shows an edge view of a 3-pole bandpass radome as an eight layer stackup.
Figure 14:
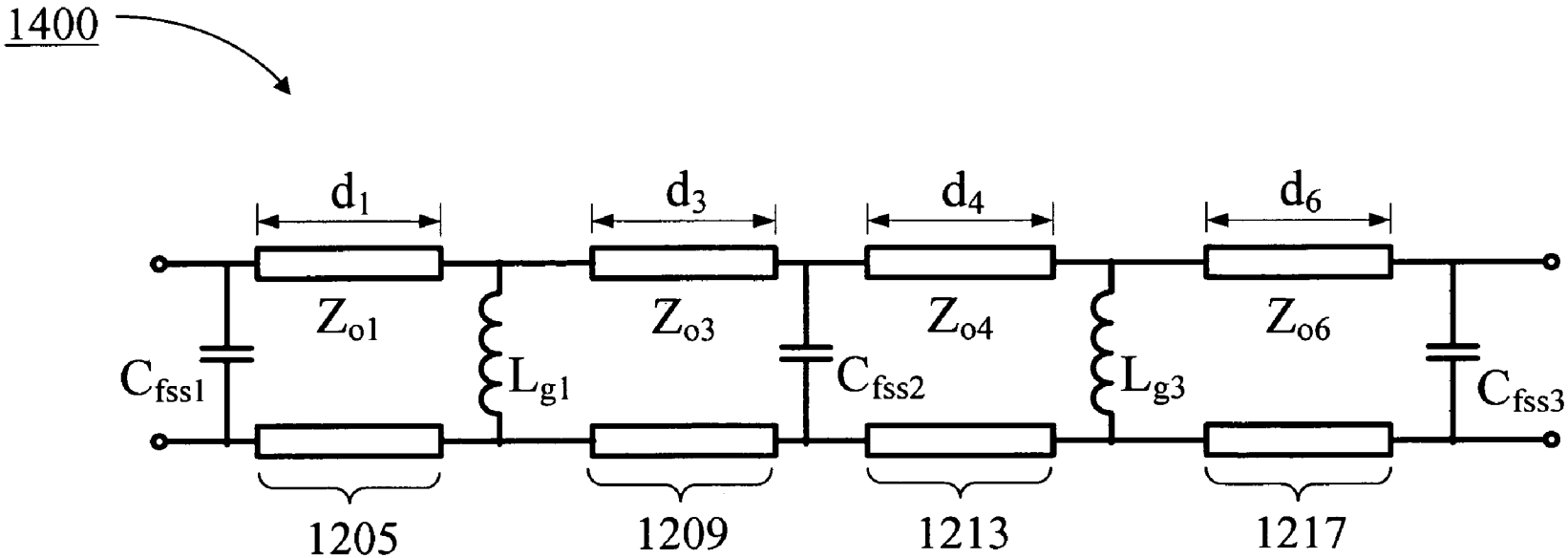
FIG. 14 is an approximate equivalent circuit model of the bandpass radome of FIG. 13 for angles near normal incidence.

One of the three poles of radome 1100 may be widely separated in frequency from the other two poles to produce a dual-band radome. However, if a single transmission band is desired, then a simpler 3-pole bandpass radome, shown as radome 1300 in FIG. 13 may be employed. The dielectric regions 107 and 115, and the inductive layers 110 and 118 have been omitted. The result is an eight-layer radome that may be thinner, lighter, and less expensive to manufacture than radome 1100. A simplified equivalent circuit 1400 for radome 1300 is shown in FIG. 14. Inductive layers 108 and 116 are modeled as shunt inductances $L_{g1}$ and $L_{g3}$ respectively. The other circuit element definitions are the same as in FIG. 12.

Figure 15:
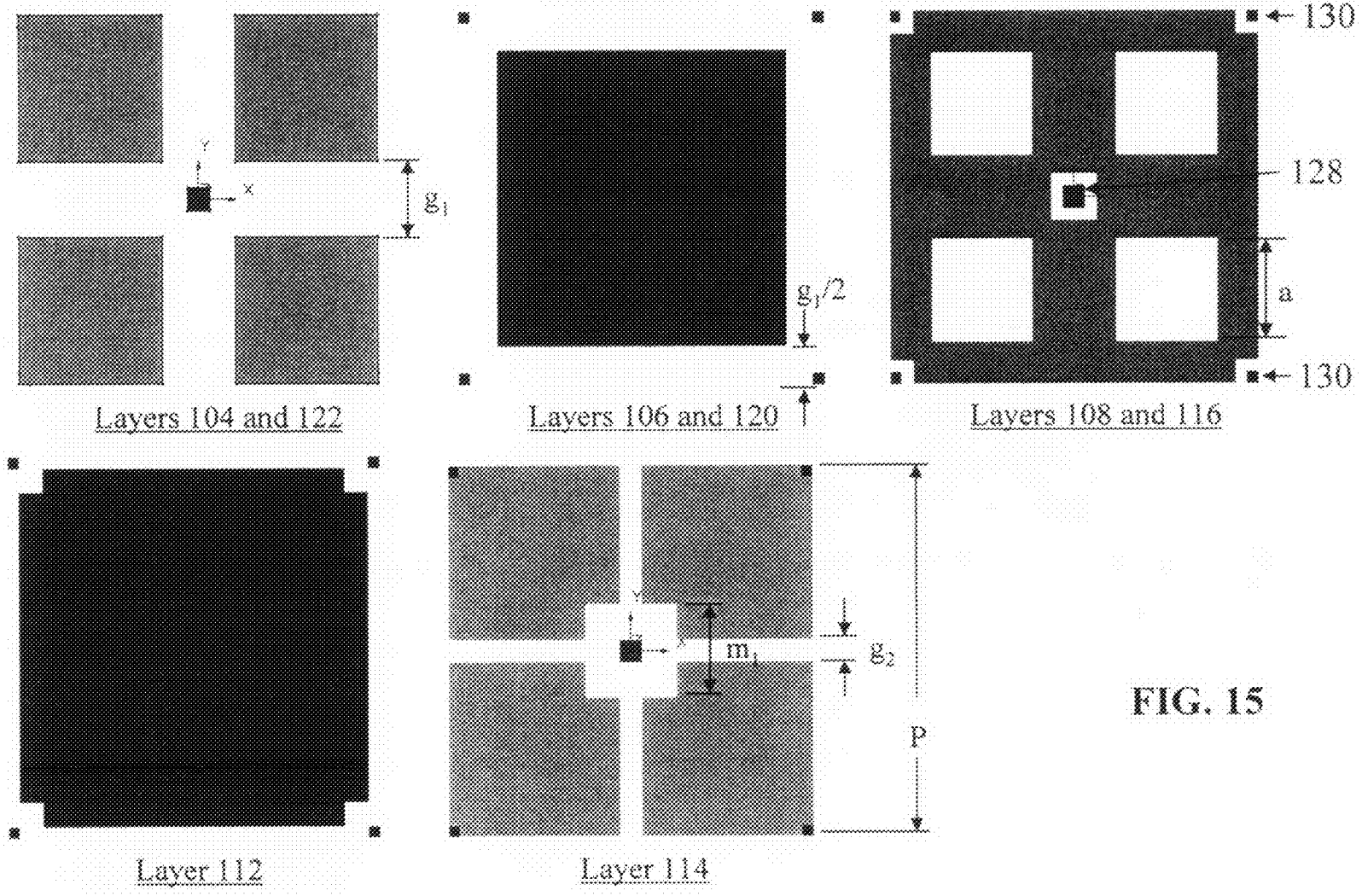
FIG. 15 is a plan view showing of all the metal layers in an example of a 3-pole bandpass radome corresponding to FIG. 13.

An example of radome 1300 is shown in plan views for the individual capacitive and inductive layers in FIG. 15. Each view shows a square unit cell of dimensions P×P. This results in a mechanically-balanced structure where capacitive layers 104 and 122 are the same, capacitive layers 106 and 120 are the same, and inductive layers 108 and 116 are the same. In this example P=8 mm, $g_1$=1.65 mm, $g_2$=0.5 mm, P'=4 mm, a=2.2 mm, the arrays of posts 128 and 130 are modeled as 0.5 mm square, and the posts are isolated from the inductive grids by 1.5 mm square antipads. The patches on layer 114 have rebated corners defined by square antipads of size ml=2 mm. Dielectric layers 103, 111, and 119 have a dielectric constant of 2.9 and a thickness of $t_1=t_2=t_3$=0.05 mm which is approximately 2 mils. Dielectric layers 105, 109, 113, and 117 have a dielectric constant of 3.38 and a thickness of $d_1=d_3=d_4=d_5$=1.7 mm which is approximately 67 mils.

Figure 16:
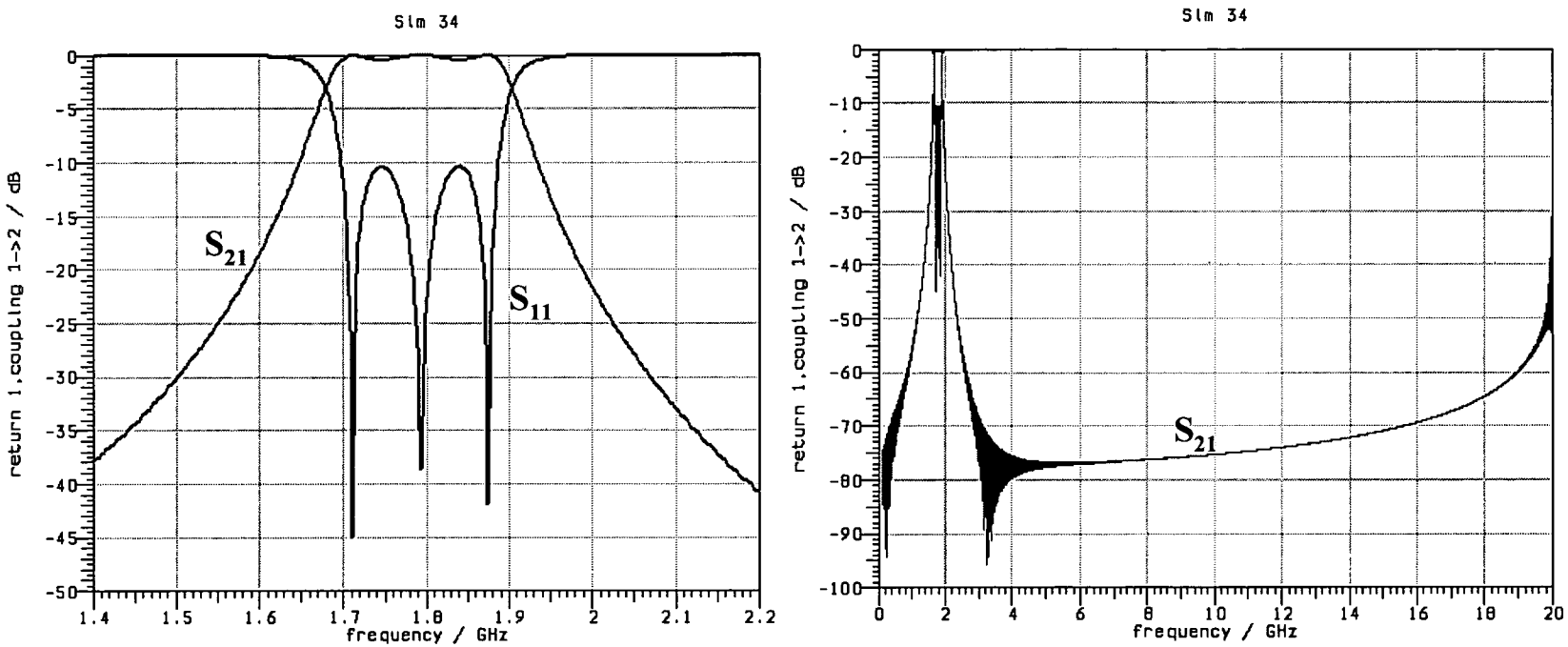
FIG. 16 illustrates transmission ($S_{21}$) and reflection ($S_{11}$) plots at normal incidence for the bandpass radome of FIGS. 13 and 15.

The simulated S parameter performance is shown in FIG. 16. Transmission and reflection S-parameters are calculated using a full-wave 3D EM simulator (Microstripes 7.1) for normal incidence. The passband is centered near about 1790 MHz, and the −10 dB return loss bandwidth is about 190 MHz or 10.6%. The passband bandwidth may be increased with a trade-off of greater passband ripple. Radome 1300 has a total thickness of approximately 6.95 mm (274 mils), ignoring the thickness of the eight metal layers. This corresponds to a normalized thickness of about λ/24 at the center of the passband, resulting in an electrically-thin radome. The small size of the unit cell places the computed spurious responses above 20 GHz. An equivalent circuit simulation was optimized to determine the effective values of the shunt inductors and capacitors, which were determined to be: $C_{fss1}=C_{fss3}$=3.32 pF/sq., $C_{fss2}$=6.62 pF/sq., and $L_{g1}=L_{g3}$=0.282 nH/sq.

The closely spaced overlapping patch layers shown in FIGS. 1, 2, 11 and 13 may be used to form a equivalent shunt capacitance. If the patch period is sufficiently large, and the passband center frequency sufficiently high, then the edge capacitance available between patches in a capacitance layer may be sufficient to achieve the desired value of capacitance. In this case, 2 or 3 closely spaced patch layers may be replaced by a single patch. Edge capacitance may be enhanced by designing patches with inter-digital fingers as taught by Rogers, McKinzie, and Mendolia in "AMCs Comprised of an Interdigital Capacitor FSS Layer Enable Lower Cost Applications," 2003 *IEEE Antennas and Propagation International Symposium*, Columbus, Ohio, Jun. 22-27, 2003, Vol. 2, pp. 411-414. Examples shown in the reference include inter-digital FSS structures of capacitance value 1.4 pF/sq. and 4.7 pF/sq., where the corresponding periods between centers of adjacent patches are 315 mils (8 mm) and 700 mils (17.8 mm) respectively.

Figure 17:
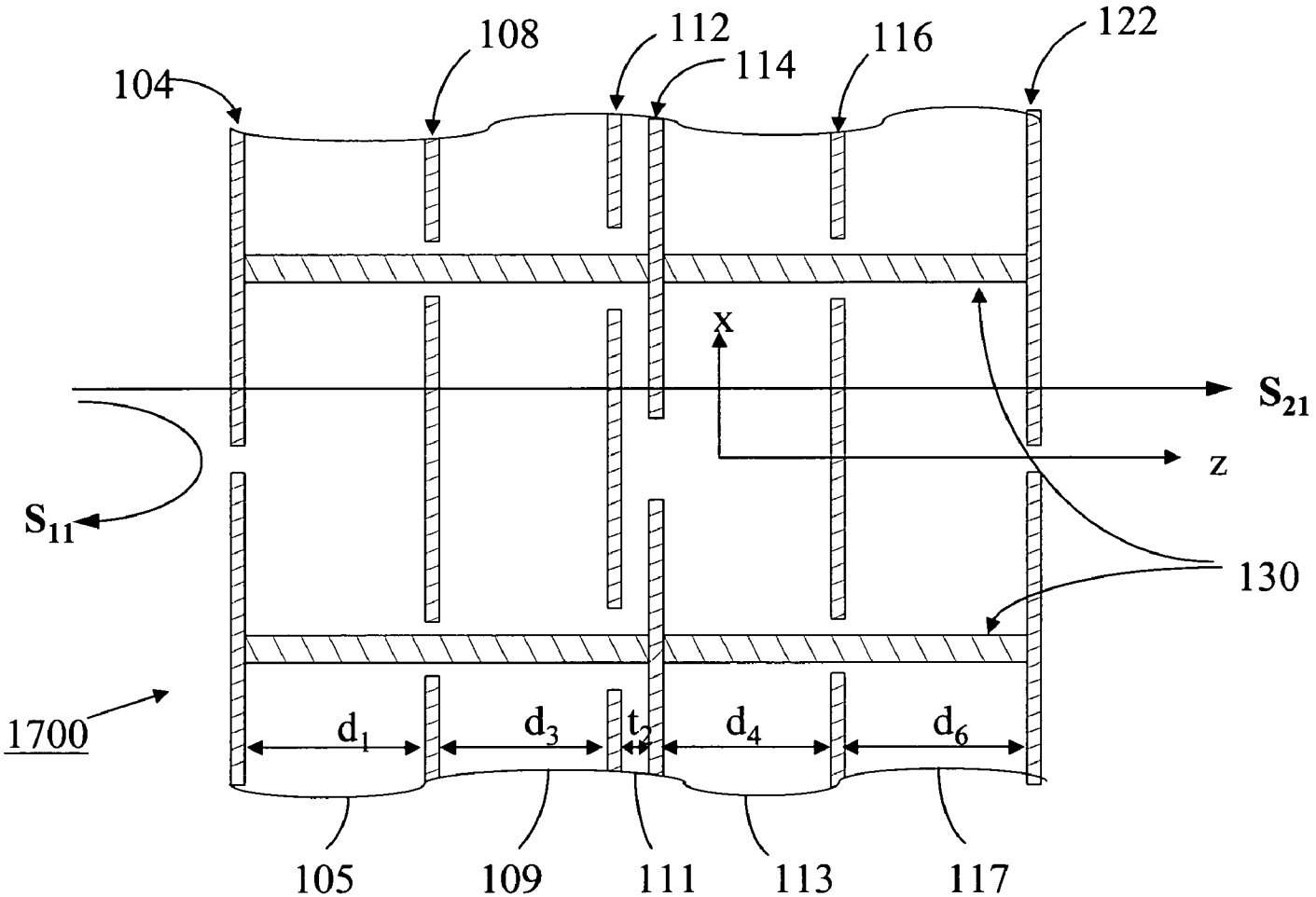
FIG. 17 shows an edge view of a 3-pole bandpass radome as a six layer stackup.
Figure 18:
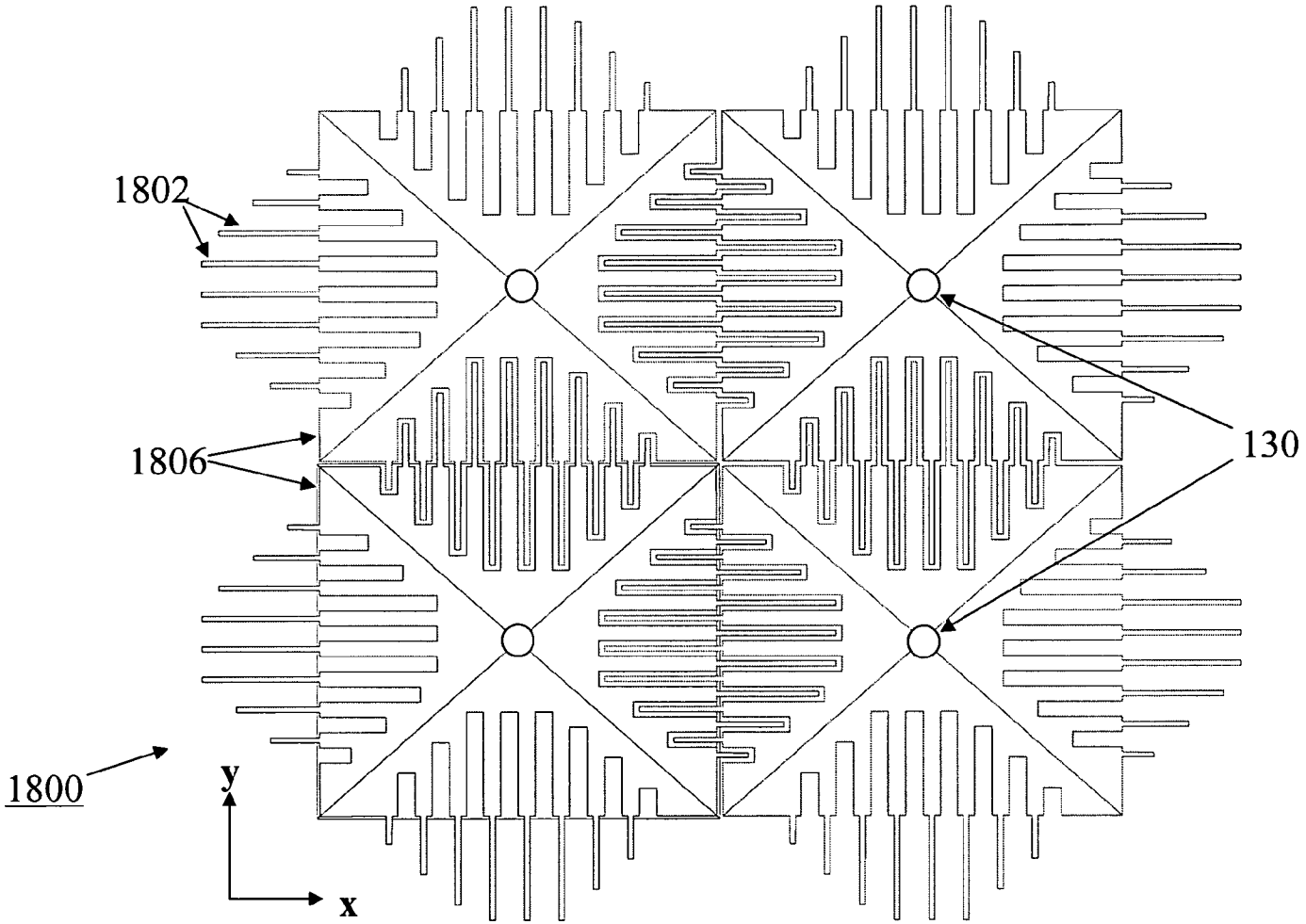
FIG. 18 shows a plan view of a capacitive layer as an array of inter-digital capacitors.

FIG. 17 shows a profile view of an example of a 3-pole response bandpass radome 1700 where the capacitive layers 104 and 122 have sufficient shunt capacitance to realize desired values of $C_{fss1}$ and $C_{fss3}$. In this example, the capacitive layers 106 and 120 have been omitted, and the dielectric layers 103 and 119 have been omitted. The elimination of patch layers 106 and 120 results in eliminating a need for the array of conductive posts 128. The remaining layers and posts are the same as in FIG. 13. Layers 104 and 122 may be etched as an array of patches having inter-digital fingers as shown in FIG. 18 to result in capacitances $C_{fss1}$ and $C_{fss2}$. Patches 1806 and fingers 1802 mesh on layer 104 with slots in adjacent patches to increase the edge capacitance. Posts 130 connect to a central region of the patches. A similar pattern of inter-digital capacitors may be used in capacitive layer 122. Using inter-digital capacitors may reduce the 3-pole bandpass radome to a 6 layer design, however above-band spurious responses may have to be considered.

Figure 19:
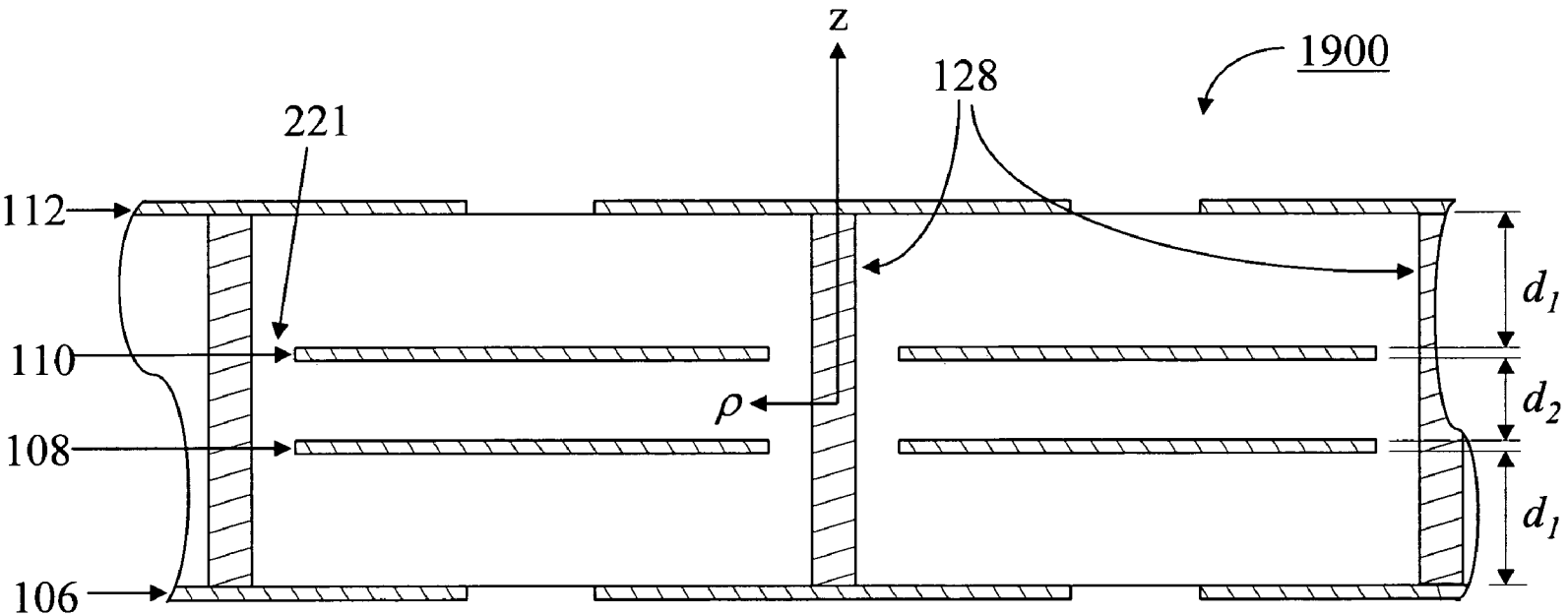
FIG. 19 shows an edge view of a 2-pole bandpass radome as a four layer stackup.

Inter-digital capacitors may be also used to reduce the number of metal layers in a 2-pole bandpass radome. FIG. 19 shows a profile view of radome 1900 where the capacitive layers 106 and 112 may be the inter-digital design of FIG. 18. Layers 108 and 110 are inductive grids. An array of conductive posts 128 connects the patches of layers 106 to 112, for TM surface wave suppression. Antipads 221 isolate the array of posts 128 from the inductive grids on the inductive layers 108 and 110.

Thus, an array of posts may be used to electrically connect patches on opposite (exterior) sides of a bandpass radome. The posts are electrically isolated from the grids on intervening inductive layers. The posts cooperate with the capacitive layers to result in a TM mode surface wave stopband that may be designed to coincide with a desired passband. The passband may then be free of undesired coupling to TM surface-wave modes that may be excited at discontinuities such as radome edges and corners.

Although the foregoing has been a description and illustration of specific examples of embodiments of the invention, various modifications and changes can be made by persons skilled in the art without departing from the scope and spirit of the invention. For example, the dielectric materials used to separate the conductive FSS layers can have different dielectric or mechanical properties. For instance, a dielectric layer may be inhomogeneous or anisotropic. The dielectric layers may not be "solid" but might be a honeycomb structure or substantially open structure to save weight. The inductive layers may contain patterns more elaborate than simple square grids, such as meandering lines. Furthermore the apertures in the inductive grids may not be essentially rectangular, but may take on more complex shapes such as circular, elliptical, or a general polygon. Some of the patches of the capacitive layers may be left floating as opposed to being connected to conductive posts. Accordingly, the invention is defined by, and limited only by, the following claims.

What is claimed is:

1. A bandpass radome, comprising:

a first patch layer;

a second patch layer disposed a first distance from the first patch layer;

a third patch layer;

a fourth patch layer disposed a second distance from the third patch layer;

conductive posts connecting at least one of the first patch layer to the fourth patch layer, or the second patch layer to the third patch layer; and a first inductive layer disposed between the second and third patch layers;

wherein the first plurality of conductive posts are electrically isolated from the first inductive layer.

2. The radome of claim 1, wherein a second inductive layer is disposed between the second and third patch layers.

3. The radome of claim 2, further comprising:

a second dielectric layer of thickness $d_1$ separating the second patch layer from the first inductive grid;

a third dielectric layer of thickness $d_2$ separating the first and second inductive grids; and a fourth dielectric layer of thickness $d_1$ separating the second inductive grid from the third patch layer.

4. The radome of claim 2, wherein the size and spacing of a first plurality of conductive posts and a second plurality of conductive posts is selected to suppress transverse magnetic (TM) mode surface waves over a specified band of frequencies, wherein the first plurality of conductive posts connects the first patch layer to the fourth patch layer, and the second plurality of conductive posts connects the second patch layer to the third patch layer.

5. The radome of claim 1, wherein the conductive posts connect the first patch layer to the fourth patch layer.

6. The radome of claim 1, wherein the conductive posts connect the second patch layer to the third patch layer.

7. The radome of claim 6, wherein the conductive posts are electrically isolated from the first and second inductive layers.

8. The radome of claim 7, wherein a first effective capacitance of the first and second patch layers, a second effective capacitance of the third and fourth patch layers, and an effective inductance of the inductive grids, are selected such that one or more distinct passbands is formed.

9. The radome of claim 1, wherein each patch layer comprises a plurality of conductive patches.

10. The radome of claim 9, wherein the conductive patches are a substantially polygonal shape.

11. The radome of claim 10, wherein a first patch of plurality of conductive patches has digit-like extensions, sized, dimensioned and positioned so as to interdigitate with digit-like extensions of an adjacent second patch of the plurality of conductive patches.

12. The radome of claim 9, wherein the conductive patches are one or more of a triangular, square, rectangular, hexagonal, pentagonal or circular shape.

13. The radome of claim 9, wherein the conductive patches form a periodic array.

14. The radome of claim 13, wherein the conductive patches form a square lattice of period P.

15. The radome of claim 14, wherein the inductive grids form a square periodic lattice of period P' where P' is equal to or greater than P.

16. The radome of claim 1, wherein the first inductive layer has a grid structure.

17. The radome of claim 1, wherein the first and second patch layers are separated by a first dielectric layer having a relative permittivity greater than unity.

18. The radome of claim 17, wherein at least one of the first distance or the second distance is 2 mils or less.

19. The radome of claim 1, wherein the size and spacing of the first plurality of conductive posts is determined to suppress transverse magnetic (TM)-mode surface waves over a specified band of frequencies, including a bandpass frequency interval.

20. The radome of claim 19, wherein one or more of the second, third or fourth dielectric layer has a relative permittivity greater than unity.

21. An apparatus, comprising:

a first inductive layer;

a first patch layer disposed above the first inductive layer;

a second patch layer disposed below the first inductive layer; and an array of conductive posts that connect the first patch layer to the second patch layer, wherein the conductive posts do not connect to the first inductive layer.

22. The apparatus of claim 21, wherein the first inductive layer is a conductive grid.

23. The apparatus of claim 22, wherein the conductive posts and the conductive grid are two-dimensional periodic structures, disposed in a square lattice; and, the spatial period of the conductive grid equals or exceeds the spatial period of the conductive posts.

24. The apparatus of claim 22, wherein each of the inductive layers and the patch layers are metal layers of a multilayer printed circuit board and the conductive posts are plated thru holes.

25. The apparatus of claim 24, wherein the multilayer printed circuit board is a substantially mechanically-balanced structure with a plane of symmetry located between the first and second patch layers.

26. The apparatus of claim 21, further comprising a second inductive layer disposed between the first patch layer and the second patch layer.

27. The apparatus of claim 26, wherein the conductive posts do not connect to the second inductive layer.

28. The radome of claim 21, wherein an effective capacitance of the first and second patch layers, and an effective inductance of the inductive layer, are selected such that one or more distinct electromagnetic transmission passbands is formed.

29. The apparatus of claim 21, wherein the conductive posts are sized and spaced to suppress transverse magnetic (TM)-mode surface waves over a band of frequencies.

30. The apparatus of claim 21, wherein the first patch layer comprises a plurality of conductive patches that have digit-like extensions, sized, dimensioned and positioned so as to interdigitate with digit-like extensions of adjacent patches of the plurality of conductive patches.

31. A bandpass radome, comprising a first patch layer, a second patch layer disposed a first distance from the first patch layer;

a third patch layer, a fourth patch layer disposed a second distance from the third patch layer;

a fifth patch layer;

a sixth patch layer disposed a third distance from the fifth patch layer;

a first inductive layer disposed between the second and third patch layers; and a second inductive layer disposed between the fourth and fifth patch layers.

32. The radome of claim 31, wherein a third inductive layer is disposed between the second and third patch layers, and a fourth inductive layer is disposed between the fourth and fifth patch layers.

33. The radome of claim 32, wherein second conductive posts connect at least some of the patches of the second layer to at least some of the patches of the fifth layer.

34. The radome of claim 32, wherein at least one of the first or the second conductive posts are electrically isolated from the first and second inductive layers.

35. The radome of claim 34, wherein the size and spacing of the conductive posts is selected to suppress transverse magnetic (TM)-mode surface waves over a band of frequencies.

36. The radome of claim 35, wherein the conductive patches form a periodic array.

37. The radome of claim 36, wherein the conductive patches form a square lattice of period P.

38. The radome of claim 37, wherein the inductive grids form a square periodic lattice of period P' where P' is equal to or larger than P.

39. The radome of claim 31, wherein first conductive posts connect at least some of the patches of the first layer to at least some of the patches of the sixth layer.

40. The radome of claim 31, wherein each patch layer comprises a plurality of isolated conductive patches and the first and second inductive layers have a grid structure.

41. The radome of claim 40, wherein the conductive patches are a substantially polygonal shape.

42. The radome of claim 31, wherein the first and second patch layers, the third and fourth patch layers, and the fifth and sixth patch layers, are separated by dielectric layers having relative permittivity greater than unity.

43. The radome of claim 31, wherein at least one of the first distance, the second distance, or the third distance is 2 mils or less.

44. An apparatus, comprising:

a first inductive layer;

a first patch layer disposed above the first inductive layer;

a second patch layer disposed below the first inductive layer;

a second inductive layer disposed below the second patch layer;

a third patch layer disposed below the second inductive layer; and conductive posts that connect the first patch layer to the third patch layer;

wherein the conductive posts do not connect to the first and second inductive layers.

45. The apparatus of claim 44, wherein the first and the second inductive layers are conductive grids.

46. The apparatus of claim 45, wherein the conductive posts and the conductive grids are arranged so as to be two-dimensionally periodic.

47. The apparatus of claim 45, wherein the inductive layers and the patch layers are metal layers in a multilayer printed circuit board and the posts are plated thru holes.

48. The apparatus of claim 44, further comprising a third inductive layer disposed between the first and second patch layers, and a fourth inductive layer disposed between the second and third patch layers.

49. The apparatus of claim 48, wherein the conductive posts do not connect to the third and fourth inductive layers.

50. The apparatus of claim 44, wherein a fourth patch layer is disposed in close proximity to the second patch layer, and located between the first and second inductive layers.

51. The apparatus of claim 50, wherein the inductive layers and the patch layers are metal layers in a multilayer printed circuit board and the posts are plated thru holes.

52. The apparatus of claim 51, wherein the multilayer printed circuit board is a substantially mechanically-balanced structure with a plane of symmetry located between the second and fourth patch layers.

53. The apparatus of claim 44, wherein the effective capacitance of the patch layers and the effective inductance of the inductive layers are determined to provide at least one transmission passband for electromagnetic plane waves.

54. The apparatus of claim 53, wherein the conductive posts are sized and spaced to suppress transverse magnetic (TM)-mode surface waves over a band of frequencies.

55. The apparatus of claim 44, wherein the first patch layer further comprises a plurality of conductive patches spaced at substantially regular intervals.

56. The apparatus of claim 55, wherein a first of the plurality of conductive patches has fingers formed in at least a portion of the peripheral surface thereof and a second of the plurality of conductive patches adjacent to the first conductive patch is orientated such that the fingers thereof interdigitate with the fingers of the first conductive patch without connecting.

57. An apparatus, comprising:

a first layer having conductive patches;

a second layer having conductive patches;

an inductive layer disposed between the first and second layers; and conductive posts joining conductive patches on the first layer to conductive patches on the second layer;

wherein the conductive posts are electrically isolated from the inductive layer.

58. The apparatus of claim 57, wherein the inductive layer comprises a plurality of conductors having an effective inductance in at least one of principal coordinate directions.

59. The apparatus of claim 58, wherein the inductive layer comprises a first inductive layer and a second inductive layer, spaced a distance apart and disposed between the first layer and the second layer.

60. The apparatus of claim 57, wherein the conductive patches have fingers formed at the periphery thereof and adjacent conductive patches are disposed so that the fingers interdigitate without connecting.

* * * * *